US007231929B2

(12) United States Patent
Landsiedel et al.

(10) Patent No.: US 7,231,929 B2
(45) Date of Patent: Jun. 19, 2007

(54) DISHWASHER AND ADJUSTABLE RACK

(75) Inventors: Jay C. Landsiedel, St. Joseph, MI (US); Chad T. VanderRoest, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 209 days.

(21) Appl. No.: 10/717,768

(22) Filed: Nov. 20, 2003

(65) Prior Publication Data

US 2005/0109378 A1 May 26, 2005

(51) Int. Cl.
*B08B 3/02* (2006.01)

(52) U.S. Cl. ..... 134/135; 134/201; 211/41.3

(58) Field of Classification Search ..... 211/41.8, 211/41.9, 41.3; 134/181, 147, 148, 179, 134/56 D, 57 D, 58 D, 201, 135
See application file for complete search history.

(56) References Cited

U.S. PATENT DOCUMENTS 1,358,507 A * 11/1920 Berford ..... 134/139
1,690,974 A * 11/1928 Hazard et al. ..... 134/176
1,959,661 A * 5/1934 Ellington et al. ..... 134/112
1,997,849 A * 4/1935 Bargar ..... 134/93
2,254,824 A * 9/1941 Large ..... 134/111
2,320,133 A * 5/1943 Horwitz ..... 134/179
2,403,526 A * 7/1946 Harris ..... 134/115 R
2,501,887 A * 3/1950 Cress ..... 134/148
2,543,993 A * 3/1951 Stanitz et al. ..... 134/141
2,563,109 A * 8/1951 Franklin ..... 134/148
2,628,628 A * 2/1953 Hertz ..... 134/148
2,907,470 A * 10/1959 Abresch ..... 211/41.8
3,044,842 A * 7/1962 Mercer et al. ..... 312/228.1
3,146,045 A * 8/1964 Kauffman ..... 312/229
3,167,183 A * 1/1965 Claywell et al. ..... 211/41.2
3,612,285 A * 10/1971 Mason ..... 211/41.8
3,752,322 A * 8/1973 Fiocca et al. ..... 211/41.8
4,606,464 A * 8/1986 Jordan et al. ..... 211/41.8

(Continued)

FOREIGN PATENT DOCUMENTS

DE 1 628 559 * 10/1971

(Continued)

OTHER PUBLICATIONS

WIPO WO 03/055375 Jul. 2003.*

(Continued)

*Primary Examiner*—Frankie L. Stinson
(74) *Attorney, Agent, or Firm*—Stephen Krefman; John Morrison; Michael Lafrenz

(57) ABSTRACT

An automatic dishwasher comprises a tub comprising a peripheral wall defining a wash chamber, a rotating water spray assembly in the wash chamber for spraying liquid into the wash chamber, at least one side sprayer in the wash chamber for spraying liquid into the wash chamber, a utensil basket within the wash chamber for holding utensils for washing by the liquid sprayed by the rotating water spray assembly and the at least one side sprayer, and an adjustable utensil carrier attached to the utensil basket and adjustable between a first position wherein a utensil placed therein is predominately exposed to direct spray from the at least one side sprayer, and a second position wherein a utensil supported thereby is exposed to direct spray from both the rotating water spray assembly and the at least one side sprayer.

39 Claims, 20 Drawing Sheets

U.S. PATENT DOCUMENTS

| | | | | | |
|---|---|---|---|---|---|
| 4,917,248 | A | * | 4/1990 | Friskney | 211/41.8 |
| 5,351,837 | A | * | 10/1994 | Smith | 211/41.8 |
| 5,480,035 | A | * | 1/1996 | Smith | 211/41.8 |
| 5,601,195 | A | * | 2/1997 | Finola et al. | 211/41.8 |
| 5,649,630 | A | * | 7/1997 | Remmler | 211/41.8 |
| 6,325,220 | B1 | * | 12/2001 | Malmstrom | 211/41.8 |
| 6,571,965 | B1 | * | 6/2003 | Beck et al. | 211/41.8 |
| 2003/0089672 | A1 | | 5/2003 | VanLandingham | 211/41.8 |

FOREIGN PATENT DOCUMENTS

| | | | |
|---|---|---|---|
| DE | 1628559 | * | 10/1971 |
| DE | 30 22 484 | * | 1/1982 |
| DE | 29621528 | | 4/1998 |
| DE | 10154630 | | 5/2003 |
| EP | 1264570 | | 11/2002 |
| EP | 1264570 | A1 | 11/2002 |
| FR | 2 276 803 | * | 1/1976 |
| JP | 7-265254 | * | 10/1995 |
| JP | 11004797 | | 1/1999 |
| JP | 11-47065 | * | 2/1999 |
| JP | 11-47066 | * | 2/1999 |
| JP | 11-342103 | * | 12/1999 |
| JP | 11004797 | | 12/1999 |
| JP | 2000-217770 | * | 8/2000 |
| JP | 2001-178670 | * | 7/2001 |
| JP | 2003-38411 | * | 2/2003 |

OTHER PUBLICATIONS

European Patent Office 0 729 725 Feb. 1996.*
European Patent Office 0 147 108 Jul. 1985.*

* cited by examiner

DISHWASHER AND ADJUSTABLE RACK

BACKGROUND OF THE INVENTION

1. Field of the Invention

This invention relates to an automatic dishwasher comprising a utensil carrier for holding cooking utensils, and, more specifically, to an adjustable utensil carrier for holding a utensil such that it can be sprayed by multiple wash liquid sources. In one aspect, the invention relates to an adjustable utensil carrier pivotably mounted to a utensil basket which can be selectively tilted relative to a plurality of wall-mounted spray nozzles and a rotating spray wash assembly between either of two positions. In another aspect, the invention relates to an adjustment mechanism pivotably attached to the adjustable utensil carrier and engaging the utensil basket for automatically tilting the adjustable utensil carrier as a cooking utensil is placed in the adjustable utensil carrier.

2. Description of the Related Art

Automatic dishwashers are well known, especially those for use in household environments. A typical automatic dishwasher comprises a cabinet that defines a washing chamber, which is accessible through a moveable door. Typically, an upper and a lower basket for holding cooking utensils to be cleaned are provided within the washing chamber. Larger utensils, such as plates, platters, and cooking pans, are frequently placed in the lower basket, with smaller utensils in the upper basket. Wash liquid is typically directed into the washing chamber through a rotating lower water spray assembly at the bottom of the washing chamber and an upper spray assembly at the top of the washing chamber. The lower spray assembly is positioned beneath the lower basket and its spray is directed up through the bottom of the basket. The upper spray assembly can be located above or below the upper basket, with its spray being directed downward or upward, respectively.

To enhance the cleaning of larger utensils, particularly cooking pans having baked on or burned food particles adhering thereto, some dishwashers are provided with a series of spray nozzles positioned along the walls of the dishwasher to spray wash liquid generally laterally toward the interior of the lower basket. The lateral spray is normally directed over and through the sides of the lower basket. Utensils placed in the lower basket are thus cleaned by water sprayed from both the rotating water spray assembly beneath the basket and the lateral spray from the side nozzles. For convenience, the combined lower and lateral spray configuration will be call a dual-mode spray.

Cleaning of the cooking utensil, such as a pan with a bottom and a peripheral wall, can be optimized by selectively positioning the utensil relative to the lower spray or dual-mode spray. In either configuration, and especially in the dual-mode configuration, the utensil must be positioned such that the peripheral wall does not block the spray from reaching the bottom of the pan. If the cooking utensil is not placed in the proper position, soil may be incompletely removed from the utensil. Thus, it is important for the cooking utensil to be properly positioned relative to the rotating water spray assembly and the spray nozzles during the washing and rinsing cycles.

For lower spray configurations, this is best accomplished by laying the utensil face down, which disadvantageously greatly reduces the number of utensils that can be washed in a single load. For the dual-mode spray, the dish is best oriented such that both the lower and the lateral spray are directed onto the bottom of the utensil and not blocked by the peripheral wall. In most cases, this requires that the bottom of the utensil be directed at an angle relative to the vertical, which advantageously takes up very little volume in the dishrack and increases the number of utensils that can be washed in a single load. The disadvantage of the dual-mode spray is that current dishracks are not specifically designed to support the utensil in such a position. The user must lean the dish against vertically extending tines in the dishrack. Many utensils are too tall for the tines to maintain the utensil in such a position throughout the wash cycle. Many utensils also have a side wall than is too tall/wide to fit between adjacent rows of tines, thereby preventing such a dish from being positioned at an angle relative to the vertical or in a vertical position.

It is desirable to have an automatic dishwasher having an auxiliary basket that can be readily adjusted to accommodate a cooking utensil in an optimal position relative to a rotating water spray assembly and spray nozzles, yet accommodate other utensils without interference from the auxiliary basket.

SUMMARY OF THE INVENTION

In one embodiment of the invention, a dishwasher comprises a tub comprising a peripheral wall defining an open-faced wash chamber, a door for selectively closing the open-face of the wash chamber a utensil basket positionable within the wash chamber and comprising a bottom wall, a peripheral wall extending upwardly from the bottom wall to define an open-top utensil holding space, and multiple tines located in the utensil holding space for holding utensils placed in the utensil basket for washing, a water spray assembly located within the wash chamber such that the water spray assembly sprays liquid into the utensil holding space through the bottom wall of the utensil basket at least one side sprayer located in the wash chamber such that the side sprayer sprays liquid laterally into the utensil holding space, and an adjustable utensil carrier located within the utensil holding space and adjustable relative to the bottom of the utensil basket to form an inclination angle relative to the bottom wall of the utensil basket such that a utensil supported by the adjustable utensil carrier can be positioned such that a food contact surface of the utensil is exposed to direct spray from both the water spray assembly and the at least one side sprayer.

The inclination angle can be approximately 35 degrees. The utensil basket can be movably mounted to the tub for movement between a stored position, where the utensil basket is completely received within the wash chamber, and a load position, where at least a portion of the utensil basket extends beyond the open-face of the wash chamber.

The adjustable utensil carrier can be moveable to a cleaning position where the adjustable utensil carrier is at an acute angle relative to the bottom of the utensil basket to form the angle of inclination. The adjustable utensil carrier can also comprise a support wall that is moveable between a stored position generally perpendicular to the bottom of the utensil basket and the cleaning position. The support wall can be pivotally mounted to the utensil basket, or hingedly mounted to the peripheral wall. The support wall can comprise a wire frame wall, and the wire frame wall can span the utensil holding space. The peripheral wall can comprise opposing side walls and the wire frame wall can extend between the opposing side walls. At least one detent latch can be mounted to one of the side walls, and the detent latch can have a detent in which a portion of the side wall is received to hold the wire frame wall in the cleaning position. The detent latch can have multiple detents to define multiple use positions, with the wire frame wall forming a different acute angle relative to the bottom wall for each of the use positions.

An actuator can couple the support wall to the peripheral wall for moving the support wall into the cleaning position, and can comprise an over-center latch for holding the support wall in the use position. The actuator can comprise a pivot mechanism pivotable between a first pivot position and a second pivot position corresponding to the cleaning position comprising a lever, a pivot, and at least one cam. The pivot can be pivotably attached to the adjustable utensil carrier, with the lever adapted to extend from the pivot into the adjustable utensil carrier, and the at least one cam adapted to extend from the pivot to engage the utensil basket.

The support wall can define an adjustable utensil carrier having a utensil holding space adapted to support a cooking utensil within the utensil holding space. In the first pivot position, the lever can extend into the utensil support space with the at least one cam below the pivot, and in the second pivot position, the lever can be retracted away from the utensil support space with the at least one cam above the pivot to form the over-center latch. In the first pivot position, the lever can extend into the utensil support space with the at least one cam below the lever, and in the second pivot position, the lever can be retracted away from the utensil support space with the at least one cam above the lever.

Placement of the cooking utensil in the adjustable utensil carrier can pivot the lever and the at least one cam from the first pivot position to the second pivot position, and the adjustable utensil carrier from the first rack position to the second rack position.

The support wall can define a utensil support space adapted to support a cooking utensil within the utensil holding space.

In another embodiment of the invention, a utensil basket for a dishwasher comprising at least one side sprayer and a rotating water spray assembly for washing utensils comprises a bottom wall a peripheral wall extending upwardly from the bottom wall to define an open-top utensil holding space multiple tines located in the utensil holding space for holding utensils placed in the utensil basket for washing and an adjustable utensil carrier located within the utensil holding space and adjustable relative to the bottom of the utensil basket to form an inclination angle relative to the bottom wall of the utensil basket such that a utensil supported by the adjustable utensil carrier can be positioned such that a food contact surface of the utensil is exposed to direct spray from both the water spray assembly and the at least one side sprayer.

DESCRIPTION OF AN EMBODIMENT OF THE INVENTION

Figure 1:
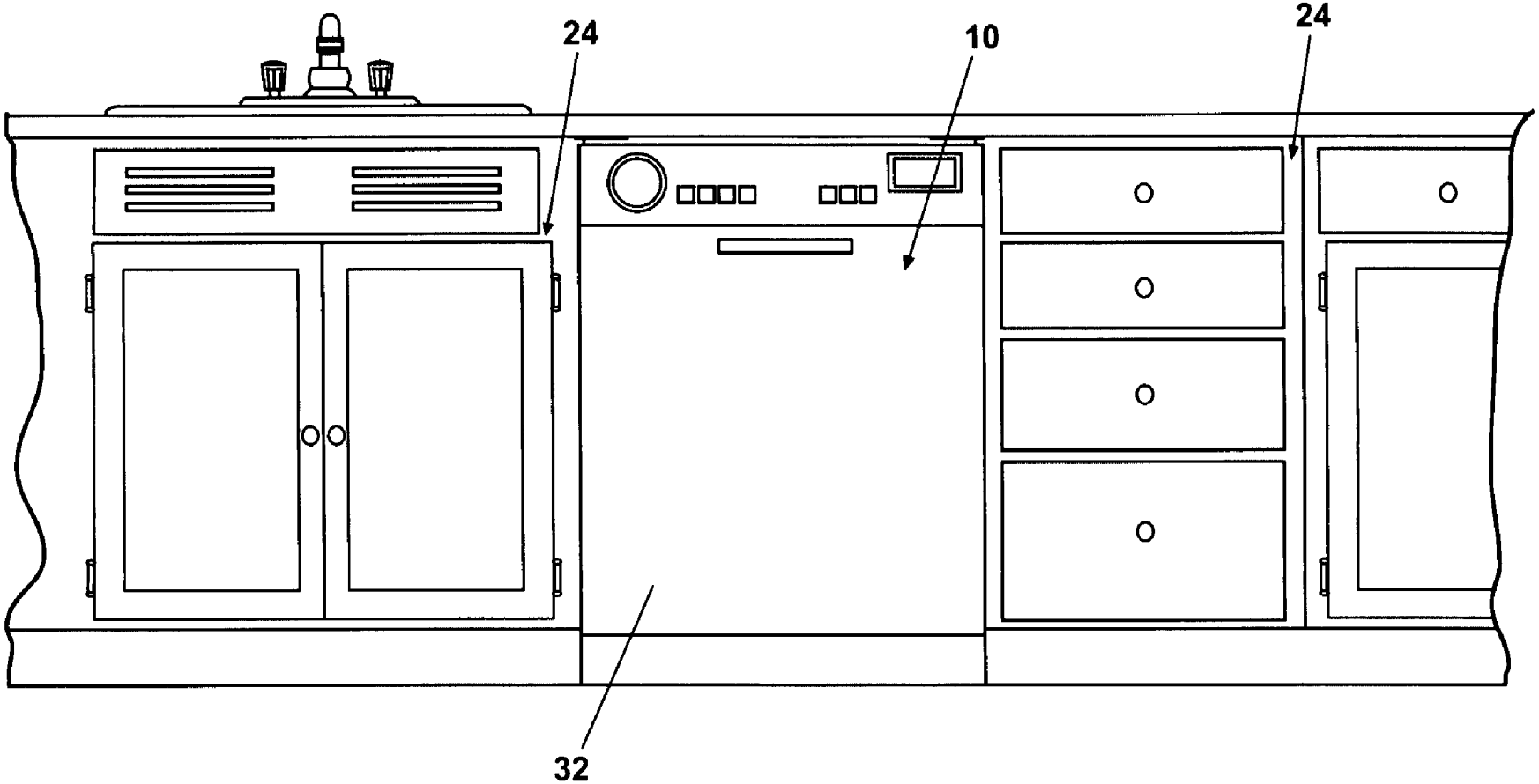
FIG. 1 is a front elevation view of an automatic dishwasher of the built-in type according to the invention shown installed in a conventional household kitchen.
Figure 2:
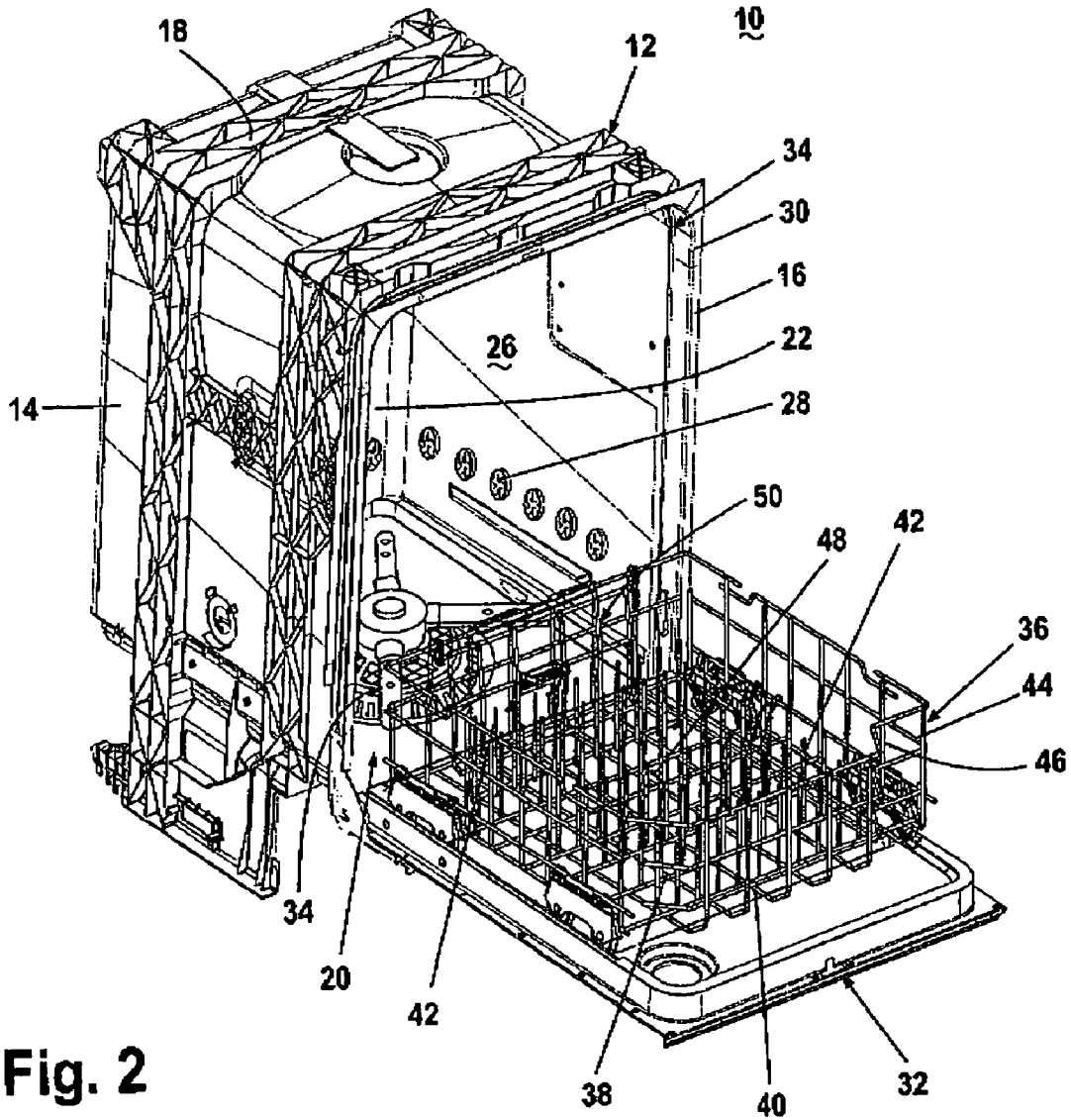
FIG. 2 is a perspective view of the automatic dishwasher of FIG. 1 comprising a housing defining a wash chamber having a plurality of wall-mounted spray nozzles, a rotating water spray assembly, and a lower basket having a first embodiment of an adjustable utensil carrier according to the invention adapted for slidable movement into and out of the wash chamber.

FIGS. 1 and 2 illustrate an automatic dishwasher 10 comprising an open-faced wash tub 12 having side walls 14, 16, whose upper and lower ends are connected by a top wall 18 and a bottom wall 20, respectively, and all of which extend away from a rear wall 22. The walls of the open-faced cabinet 12 define a washing chamber 26 to which access is obtained through a front opening 30 defined by the forward edges of the top wall 18, the bottom wall 20, and the side walls 14, 16. A door 32 is hingedly mounted to the wash tub 12 for movement between an open position (shown), where the door 32 is generally horizontal, to a closed position, where the door 32 covers the front opening 16 and seals the washing chamber 26.

The automatic dishwasher 10 further comprises a lower basket 36 for holding utensils of various shapes and sizes. As used in this application, the term "utensil" refers to any item washed in the automatic dishwasher, including, without limitation, pots, pans, plates, glasses, silverware, and the like. The automatic dishwasher also typically comprises a well-known upper basket, which is omitted from the Figures for purposes of clarity. Finally, the automatic dishwasher 10 further comprises a well-known rotating water spray assembly 34, shown in FIG. 2, mounted to the bottom wall 20 and adapted to spray wash liquid upwardly into the washing chamber 26. The spray assembly 34 is part of the liquid recirculation system for the dishwasher. Such recirculation systems are widely known, and thus will not be described in greater detail.

The automatic dishwasher 10 shown in FIG. 1 is a built-in type designed to be mounted within a cabinet system 24 and does not have an external or decorative housing. However, the invention as described herein applies to all types of automatic dishwashers regardless of the particular type. The dishwasher 10 of FIG. 1 is also shown for purposes of clarity without the heating element typically comprising parts of the dishwasher 10. These features are well known and are not germane to the invention.

The automatic dishwasher 10 shown in FIG. 2 is provided with a plurality of spray nozzles 28, also referred to herein as side sprayers or zone wash nozzles, arranged along the lower portion of the side walls 14, 16 and the rear wall 22. These zone wash nozzles 28 are fluidly connected to the recirculation system and are adapted to deliver wash liquid under pressure into the interior of the lower basket 36 and against the utensils supported therein to complement the upwardly-directed spray from the rotating water spray assembly and enhance the cleaning of heavily soiled utensils. The invention disclosed herein can be utilized in automatic dishwashers having only rotating water spray assemblies, or in dishwashers having a combination of rotating water spray assemblies and zone wash nozzles. The latter configuration will be referred to herein as a "dual-mode spray configuration."

Figure 3:
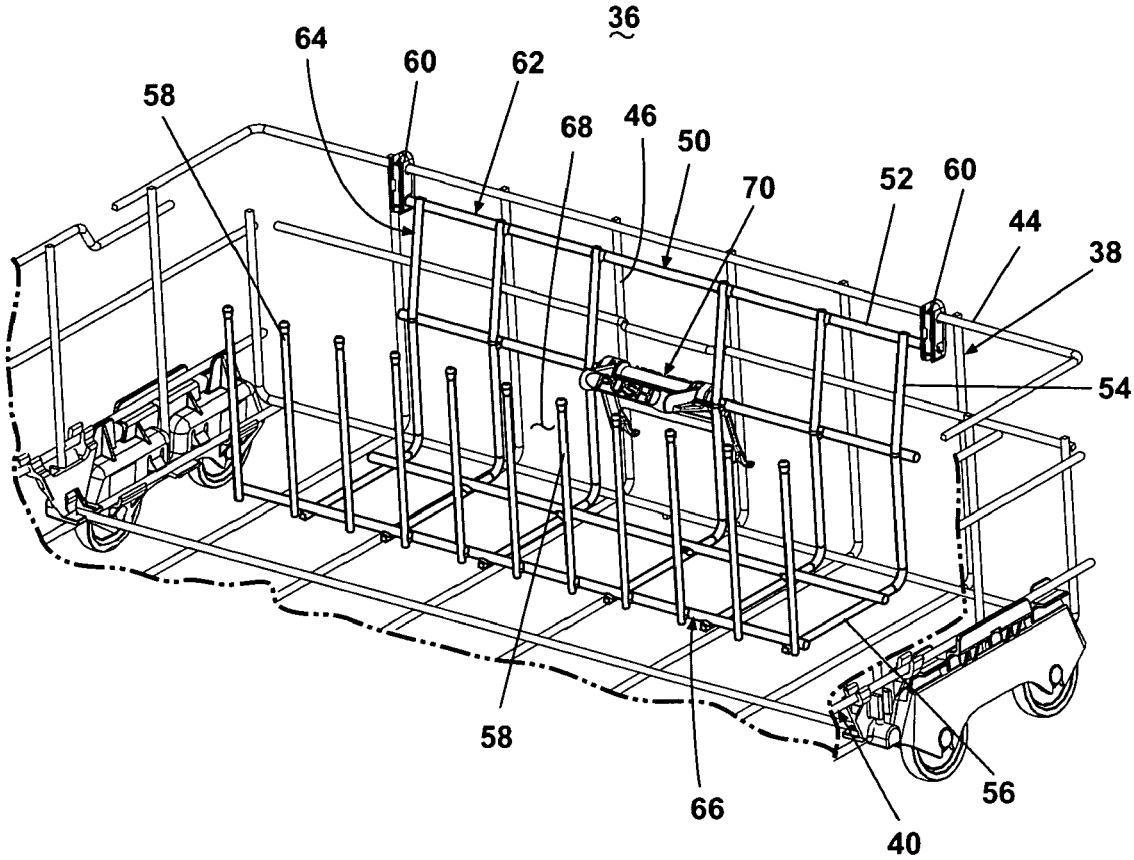
FIG. 3 is an enlarged perspective view of a portion of the lower basket of FIG. 2 and illustrating the adjustable utensil carrier pivotably mounted to the lower basket by a pair of hinge assemblies, and having a utensil carrier adjuster for pivoting the adjustable utensil carrier relative to the lower basket. A portion of the lower basket is removed for clarity.
Figure 4:
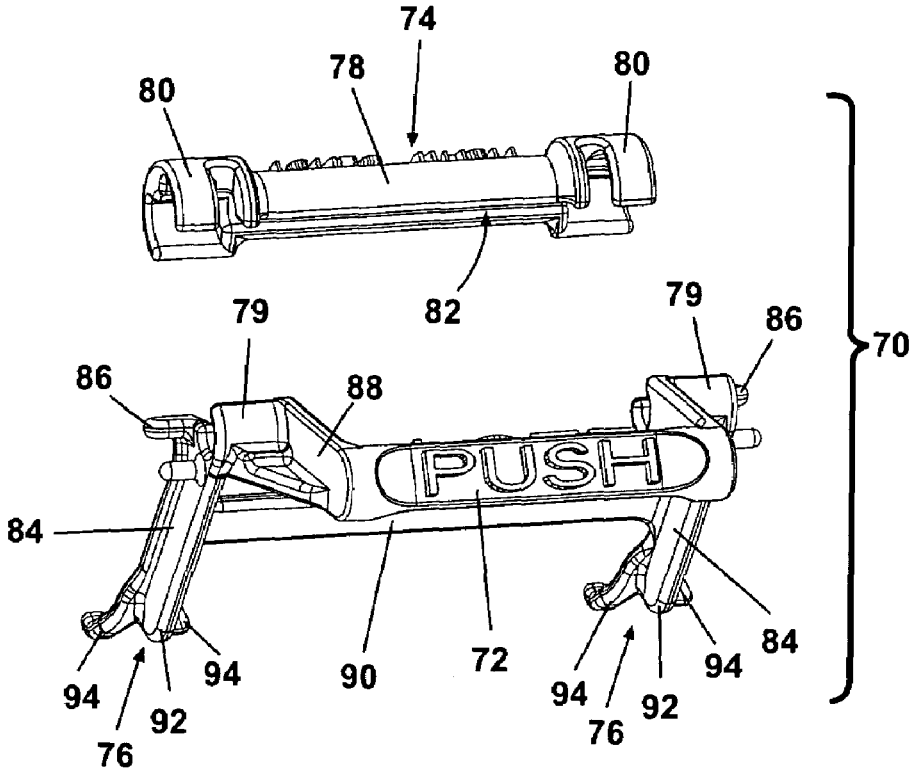
FIG. 4 is an exploded front view of the utensil carrier adjuster of FIG. 3.
Figure 5:
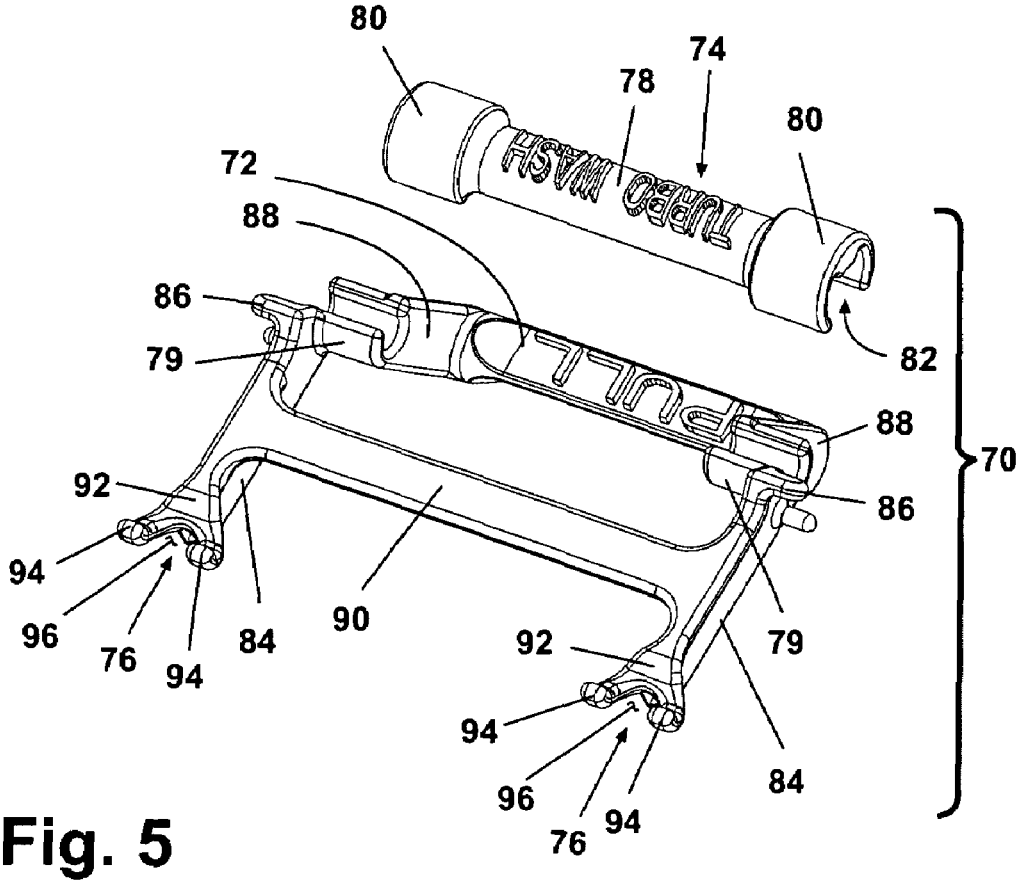
FIG. 5 is an exploded rearview of the utensil carrier adjuster of FIG. 3.

The lower basket 36 is shown in FIGS. 2 and 3 having a generally rectilinear wire-frame construction and configuration. The basket 36 comprises a perimeter wall, shown as a perimeter latticework 38, comprising a plurality of cross members 44 and vertical members 46, extending upwardly from a bottom wall, shown as a floor latticework 40, to define a utensil holding space 48. A plurality of positioning tines 42 extend upwardly from the floor latticework 40 into the utensil holding space 48 to aid in positioning the various shapes and sizes of utensils within the basket 36. FIG. 2 also illustrates an adjustable utensil carrier 50 according to the invention hingedly attached to the perimeter latticework 38 at the rear of the lower basket 36, and adapted to support one or more kitchen utensils for optimal delivery of wash liquid to the kitchen utensils from the zone wash nozzles 28 attached to the rear wall 22, as described more fully hereinafter. Alternatively, the adjustable utensil carrier 50 can be attached to a side of the lower basket 36 for delivery of wash liquid from zone wash nozzles 28 attached to one of the side walls 14, 16. It should be understood that, while the adjustable utensil carrier 50 is described herein with respect to an embodiment that is particularly well-suited for use in an automatic dishwasher that comprises both a rotating water spray assembly and zone wash nozzles, the adjustable utensil carrier 50 can also be incorporated into an automatic dishwasher without zone wash nozzles.

As shown in FIGS. 3–8, the adjustable utensil carrier 50 comprises a utensil basket 62, a utensil carrier actuator 70, and a pair of hinge assemblies 60. The utensil basket 62 has a generally wire-frame construction comprising a plurality of rigidly interconnected cross members 52 and vertical members 54 in generally rectilinear orientation to form a support wall 64, shown in FIG. 3 as a vertical latticework. Each vertical member 54 transitions generally orthogonally to a floor wire 56 to form, with the cross members 52, a floor latticework 66. The support wall 64 and the floor latticework 66 define a utensil support space 68. Extending generally orthogonally from the floor latticework 66 and parallel to the support wall 64 is a plurality of positioning tines 58 adapted to aid in positioning utensils within the utensil support space 68. It will be understood that the cross members and the vertical members can comprise other than a rectilinear configuration, and that the utensil basket can have an overall form other than rectilinear, such as a parallelogram, quadrilateral, or arcuate.

Each hinge assembly 60 comprises a suitable, generally well-known device adapted for attachment to a cross member 44 and a cross member 52 to enable rotation of the cross member 52 relative to the hinge assembly 60. As shown in FIGS. 3–8, the hinge assembly 60 comprises a generally solid body having a first channelway extending through a first end thereof for receipt of the cross member 44 and a second channelway extending through a second end thereof for receipt of the cross member 52. The hinge assembly 60 can comprise mating halves adapted to be assembled in a snap fit relationship around each cross member 44, 52 to form the hinge assembly 60 therearound. It can be recognized from FIGS. 3 and 8 that the hinge assembly 60 enables pivoting of the utensil basket 62 relative to the lower basket 36.

Referring specifically to FIGS. 4–7, the utensil carrier actuator 70 is a somewhat L-shaped body comprising an actuator lever 72, a pivot 74, and a pair of cams 76. The pivot 74 comprises an elongated, generally tube-shaped annular pivot member 78 transitioning at either end to a semi-annular pivot collar 80, and a pair of semi-annular pivot sleeves 79. The pivot collars 80 are adapted for snap-fit installation around the pivot sleeves 79 to form a wire channel 82 extending coaxially through the pivot 74 and adapted for rotatable receipt of a cross member 52 therein. The attachment of the pivot 74 to a cross member 52 will enable the pivot 74 to rotate relative to the cross member 52.

The actuator lever 72 comprises an elongated, generally rod-shaped member rigidly attached generally orthogonally at either end to a connecting arm 88. Each connecting arm 88 is rigidly attached generally orthogonally to pivot sleeves 79 so that the actuator lever 72 is rigidly attached to the pivot 74 in spaced-apart parallel juxtaposition.

Each cam 76 comprises a somewhat irregularly-shaped, over-center cam body 92 having a pair of spaced-apart cam flanges 94 to form a wire slot 96 therebetween. Each cam 76 is rigidly attached to a first end of a pivot arm 84, the second end of which is rigidly attached to a pivot sleeve 79 to align the pivot arms 84 in spaced-apart parallel juxtaposition. Rigidly connecting the pivot arms 84 at an intermediate point thereof is a cross member 90 spaced away from and parallel to the pivot 74 and the actuator lever 72. Extending outwardly from the pivot arms 84 adjacent the pivot sleeves 79 are a pair of stop flanges 86.

Figure 6:
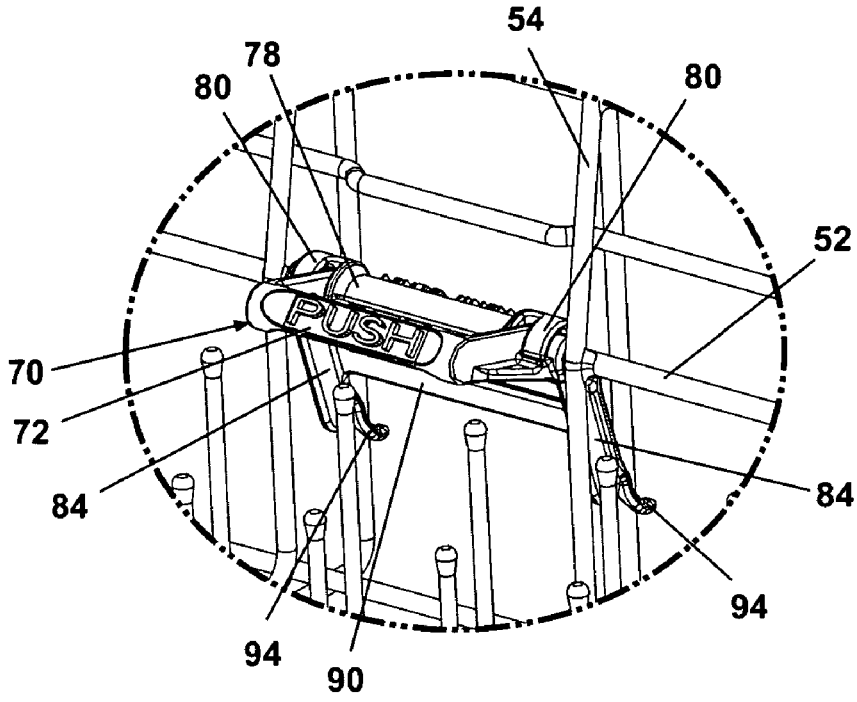
FIG. 6 is an enlarged perspective view of the utensil carrier adjuster of FIG. 3 shown in a first operable position.
Figure 7:
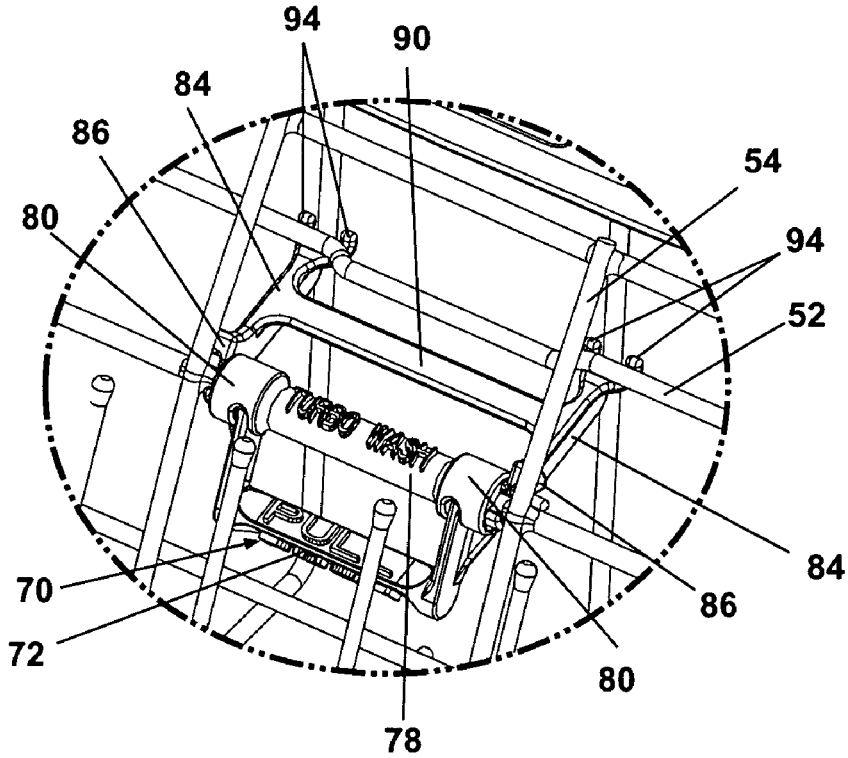
FIG. 7 is an enlarged perspective view of the utensil carrier adjuster of FIG. 3 shown in a second operable position.
Figure 8:
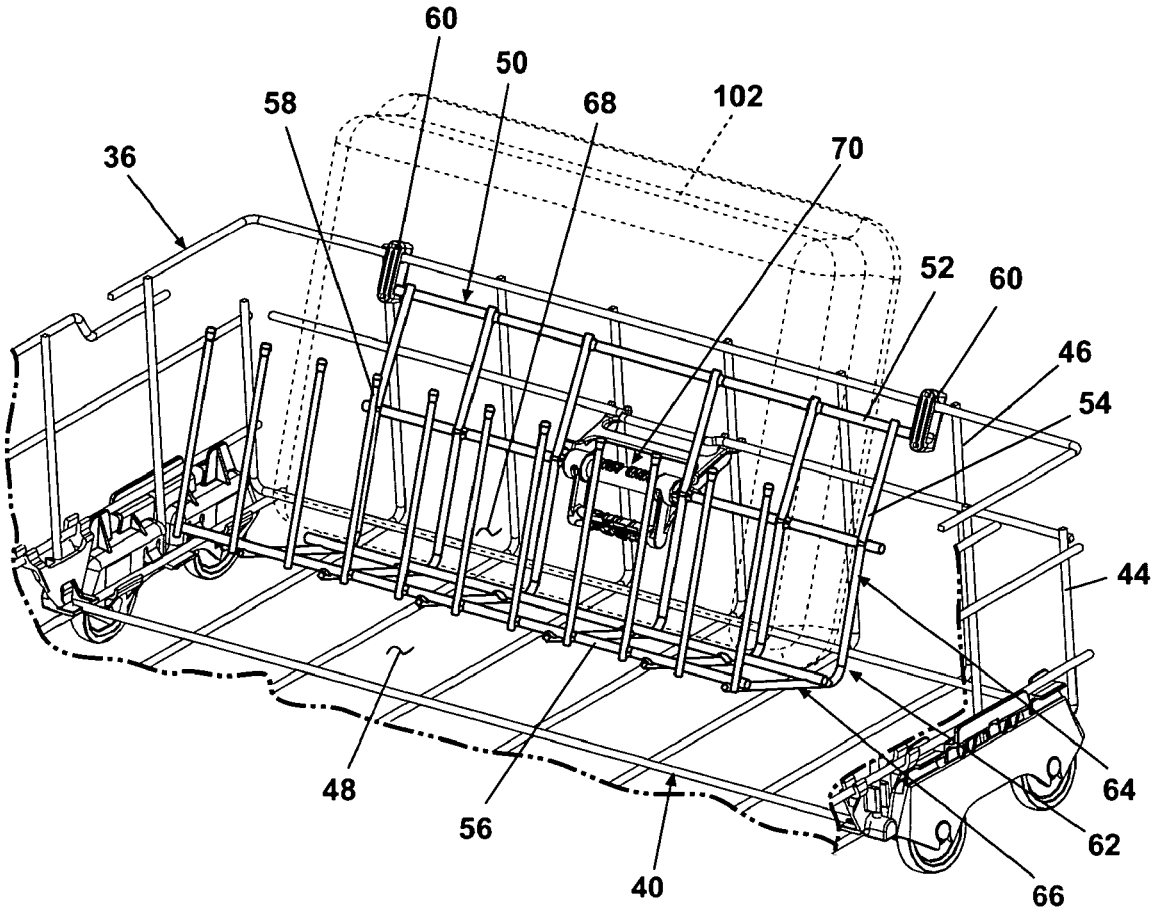
FIG. 8 is an enlarged perspective view of a portion of the lower basket of FIG. 2 illustrating the utensil carrier adjuster in the second operable position to optimally position the adjustable utensil carrier for cleaning of a cooking utensil, the cooking utensil shown in phantom and a portion of the lower basket removed for purposes of clarity.

As shown in FIGS. 4–7, the utensil carrier actuator 70 is attached to a cross member 52 by inserting the cross member 52 into the pivot sleeves 79 and attaching the pivot member 78 to the pivot sleeves 79 so that the cross member 52 is received in the wire channel 82. The utensil carrier actuator 70 is attached to the cross member 52 so that the actuator lever 72 extends into the interior of the adjustable utensil carrier 50 and a pair of vertical members 46 is received in the wire slots 96. Referring specifically to FIGS. 6 and 7, as so assembled the utensil carrier actuator 70 will pivot about the cross member 52 so that the actuator lever 72 will translate vertically between a first position (FIG. 6), in which the actuator lever 72 extends into the interior of the adjustable utensil carrier 50, and a second position (FIG. 7), in which the actuator lever 72 lies generally in the plane of the support wall 64. These positions are also illustrated in FIGS. 10A and 10D, respectively.

At the same time, the cams 76 will engage a pair of vertical members 46, with each vertical member 46 received within a wire slot 96, and will travel vertically along the vertical members 46 as the actuator lever 72 moves between the first position and the second position. The cam flanges 94 will maintain the cams 76 in the proper position along the vertical members 46 during this movement. In the second position, the cams 76 are in an over-center position relative to the pivot 74 and abutting one of the cross members 52 to temporarily lock the cams 76 in the second position.

Figure 10A:
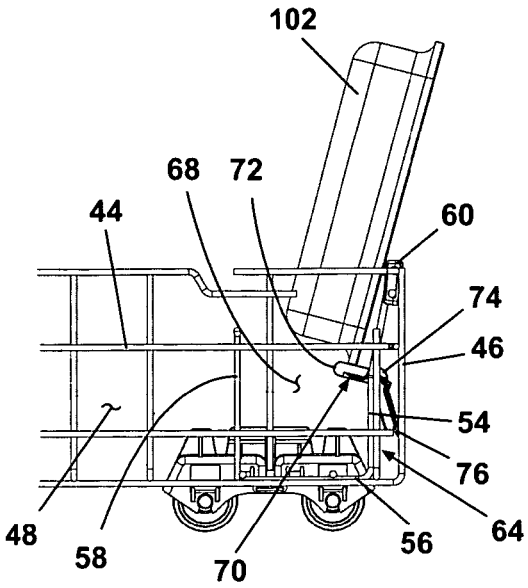
FIGS. 10A–D are side elevational views of a portion of the lower basket of FIG. 2 illustrating the insertion of a cooking utensil into the adjustable utensil carrier and the pivoting of the adjustable utensil carrier relative to the lower basket through an engagement of the cooking utensil with the utensil carrier adjuster.
Figure 10B:
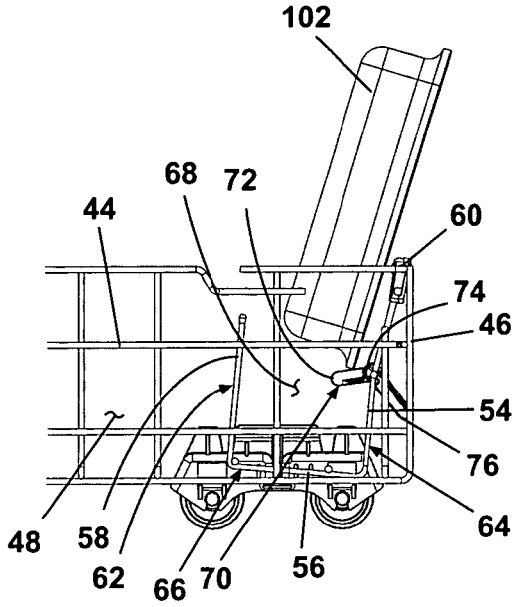
Figure 10C:
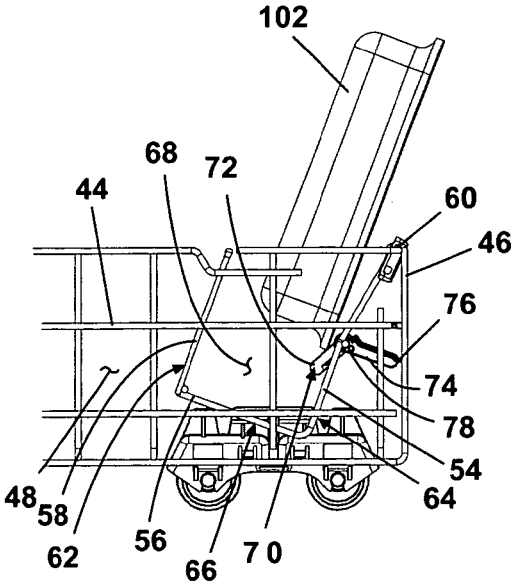
Figure 10D:
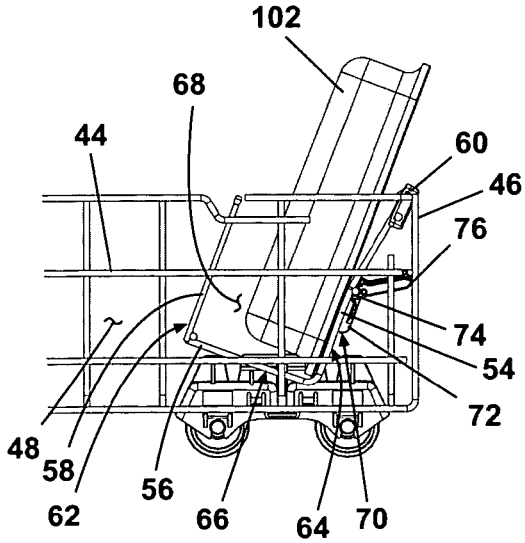

Referring to FIGS. 10A and 10D, it will be seen that, as the actuator lever 72 moves from the first position shown in FIG. 10A to the second position shown in FIG. 10D, the movement of the cams 76 will urge the utensil basket 62 away from the lower basket 36. With the upper portion of the utensil basket 62 attached to the lower basket 36 through the hinge assemblies 60, the utensil basket 62 will be angularly moved away from the lower basket 36. As shown in FIG. 7, the stop flanges 86 will engage the vertical members 54 when the utensil carrier actuator 70 is moved to the second position. This will maintain the utensil carrier actuator 70 in the proper position and will prevent over-rotation of the utensil carrier actuator 70 during use.

Figure 9:
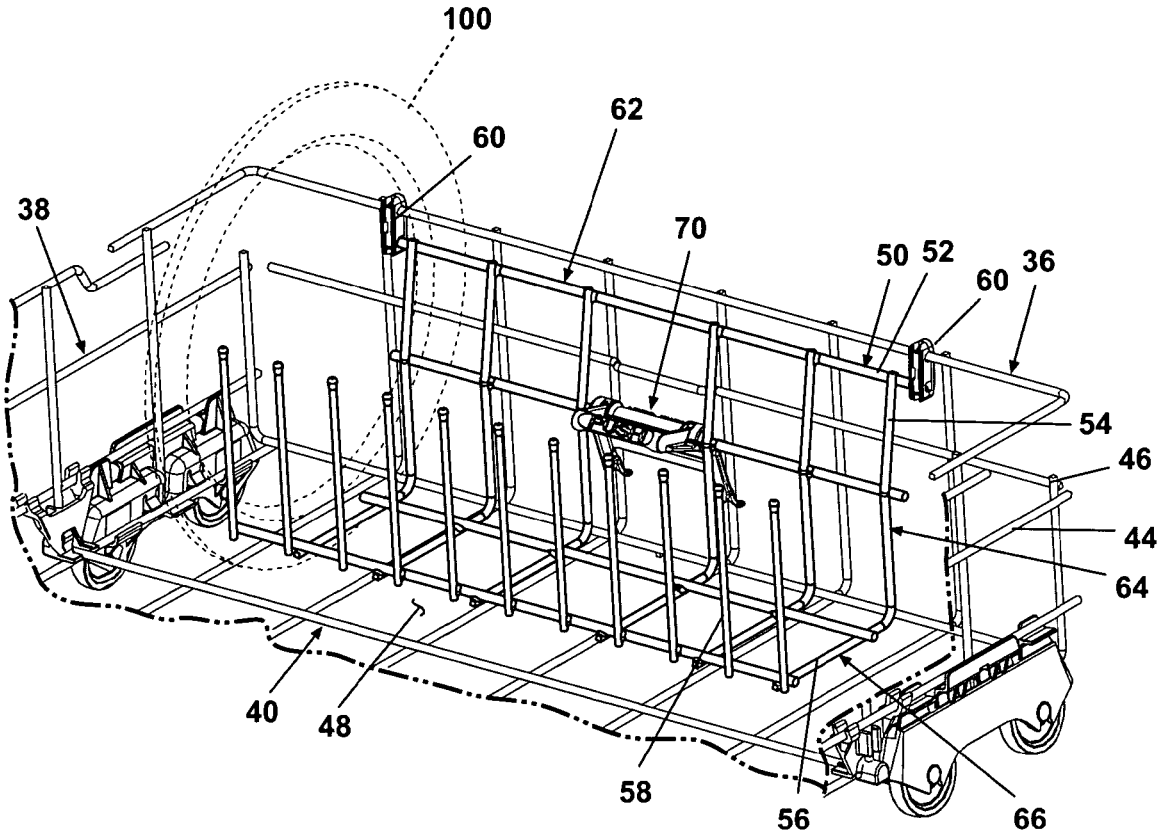
FIG. 9 is an enlarged perspective view of a portion of the lower basket of FIG. 2 illustrating the utensil carrier adjuster in the first operable position to position the adjustable utensil carrier for receipt of a plate, the plate shown in phantom and a portion of the lower basket removed for purposes of clarity.

As shown in FIG. 9, with the utensil basket 62 in the first position, the lower basket 36 can be loaded with dinnerware, such as plates 100, glasses, platters, and the like, without interference from the utensil basket 62. As shown in FIGS. 10A–D, large cooking pans 102 can be placed in the lower basket 36 and automatically oriented in the optimal position relative to the zone wash spray jets 28 and the rotating water spray assembly 34 through the action of the adjustable utensil carrier 50. As shown in FIG. 10A, as the pan 102 is inserted into the utensil basket 62, it will engage the actuator lever 72. As shown in FIG. 10B, as the pan 102 is lowered into the utensil basket 62, it will urge the actuator lever 72 downwardly, pivoting the utensil carrier actuator 70 about the pivot 74. This will urge the cams 76 upwardly along the vertical members 46. As shown in FIG. 10C, further lowering of the pan 102 into the utensil basket 62 will farther urge the cams 76 upwardly along the vertical members 46, thereby pivoting the utensil basket 62 away from the lower basket 36. As shown in FIG. 10D, with the pan of 102 fully inserted into the utensil basket 62, the utensil basket 62 will be fully pivoted away from the lower basket 36, thereby placing the pan 102 in the optimal orientation relative to the zone wash spray jets 28 and the rotating water spray assembly 34 for cleaning.

Figure 11:
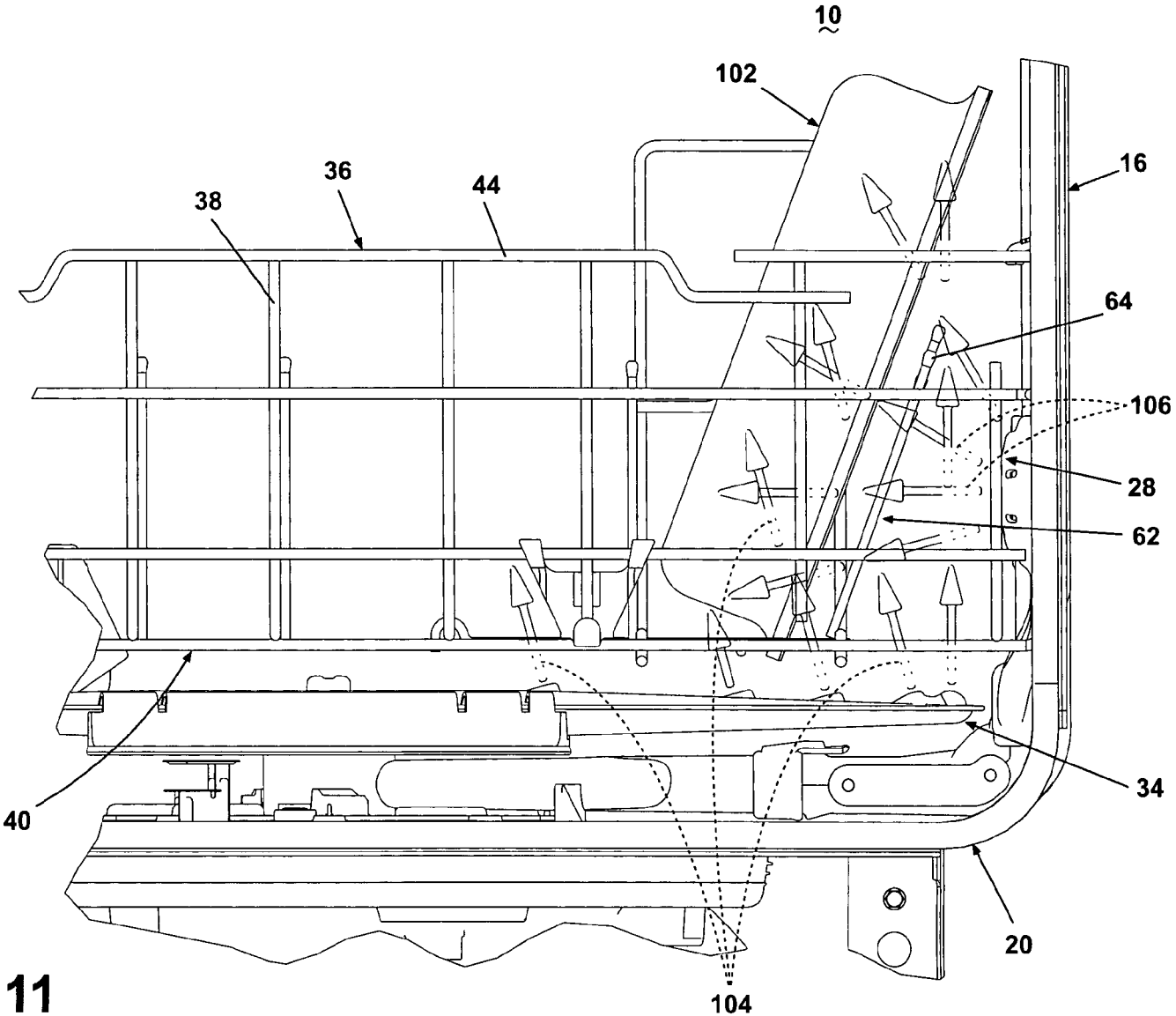
FIG. 11 is an enlarged elevational view of a portion of the lower basket of FIG. 2 illustrating the flow of wash liquid from the wall-mounted spray nozzles and the rotating water spray assembly against the cooking utensil.

Referring to FIG. 11, the pan 102 will be optimally oriented for wash liquid from the rotating water spray assembly 34 (identified by the numeral 104 in FIG. 11) and the zone wash spray jets 28 (identified by the numeral 106 in FIG. 11) to be directed against the dish 102, thereby providing the optimal volume and cleaning effectiveness of the spray liquid 104, 106. The optimal position of the utensil basket 62 has been found to correspond to an inclination angle of the floor latticework 66 of the utensil basket 62 relative to the floor latticework 40 of the lower basket 36 equal to 35°. This inclination angle can be established at other values for automatic dishwashers having different sizes and different basket and sprayer configurations to provide the optimal orientation of the utensil for cleaning.

With the pan 102 removed, the utensil basket 62 can be returned to the position shown in FIG. 10A by pulling upwardly on the actuator lever 72. It will also be recognized that the utensil basket 62 can be placed in the position shown in FIG. 10D by manually moving the actuator lever 72 from the first position to the second position.

It should be noted that the precise configuration, including the lengths of the connecting arms 88 and the pivot arms 84, and the angle formed by the connecting arms 88, the pivot 74, and the pivot arms 84, can be adapted to accommodate differing sizes of adjustable utensil carriers 50 in order to provide the desired orientation of the utensil basket 62 and pan 102 relative to the zone wash spray jets 28 and the rotating water spray assembly 34.

The adjustable utensil carrier provides a specialized automatic dishwasher rack for supporting cooking pans and the like in the optimal washing orientation relative to a dual-mode spray configuration. The use of the utensil carrier actuator described herein ensures that the adjustable utensil carrier is placed in the optimal washing position. Particularly with the dual-mode spray configuration, the utensil is positioned such that the peripheral wall does not block the spray from reaching the soiled bottom of the pan. With the cooking utensil placed in the proper position, soil will be thoroughly removed from the utensil. Moreover, the placement of the utensil in a generally vertical position optimizes the use of the wash tub space that would otherwise be taken up by a utensil placed face down. Consequently, a greater number of utensils can be washed at the same time.

Figure 12A:
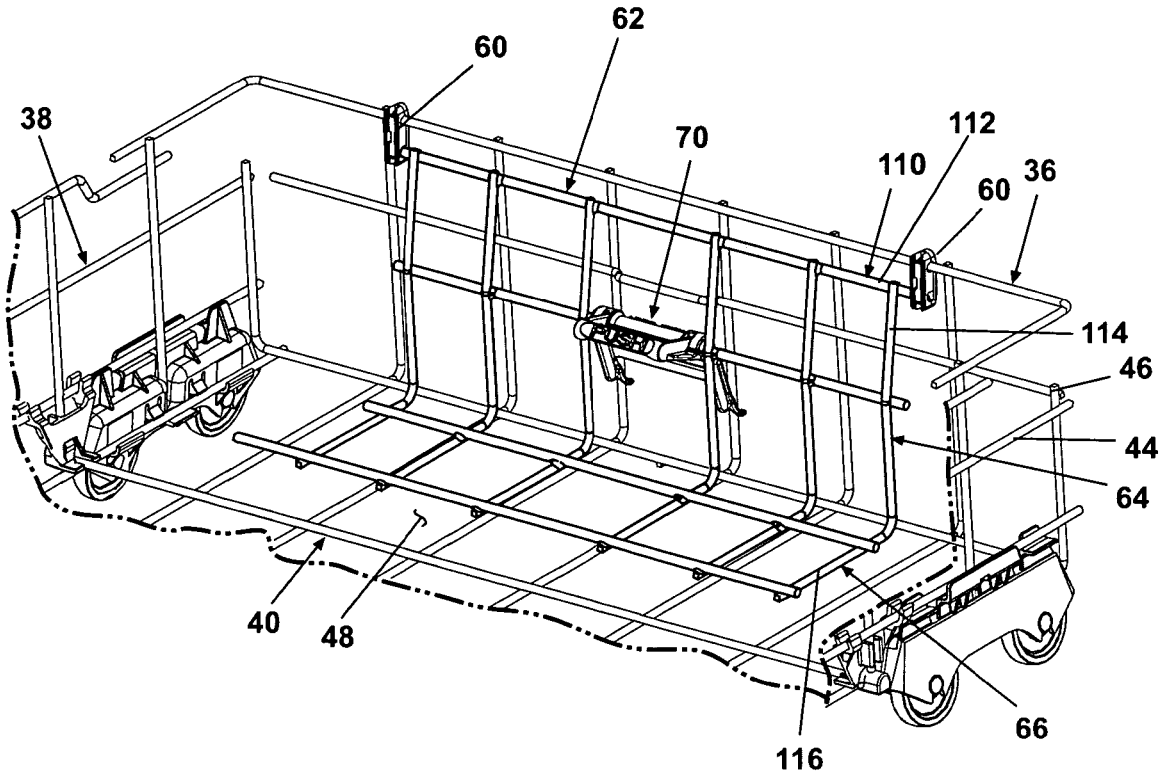
FIGS. 12A–B are enlarged perspective views of a portion of the lower basket of FIG. 2 illustrating a second embodiment of the adjustable utensil carrier in a first operable position and a second operable position, respectively, with a portion of the lower basket removed for clarity.
Figure 12B:
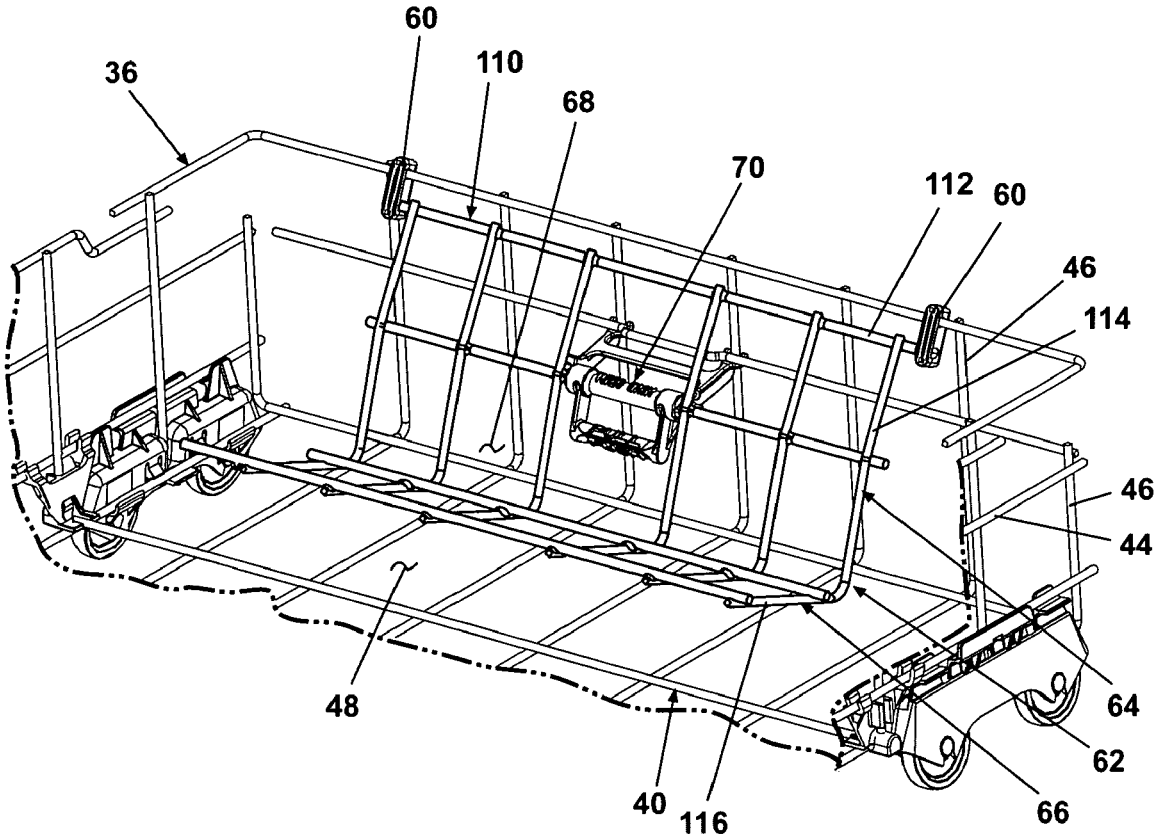

The adjustable utensil carrier also eliminates the need to carefully position and balance large utensils against the vertically extending tines in the dishrack, and the potential that the utensil will shift out of the optimal cleaning position during washing. The adjustable utensil carrier also eliminates the problem that arises when a utensil is too tall for the vertically extending tines in the dishrack to maintain the utensil in the optimal position throughout the wash cycle. When the adjustable utensil crier is not needed, it can be readily positioned or removed so that tableware and other utensils can be loaded into the dishwasher without interference from the adjustable utensil carrier. Finally, the adjustable utensil carrier is simple in design and operation, economical to produce, and can readily be retrofit to an existing dishwasher rack. FIGS. 12A–B illustrate a second embodiment of the invention comprising an adjustable utensil carrier 110 having a generally wire-frame construction comprising a plurality of rigidly interconnected cross members 112 and vertical members 114 in generally rectilinear orientation to form a support wall. Each vertical member 114 transitions generally orthogonally to a floor wire 116 to form, with the cross members 112, a floor latticework. The adjustable utensil carrier 110 is provided with the utensil carrier actuator 70. The resulting adjustable utensil carrier 110 is similar to the adjustable utensil carrier 50 except for the omission of positioning tines. The omission of the positioning tines in the adjustable utensil carrier 110 enables a greater range of pan sizes to be supported in the utensil carrier 110 unaffected by the tine spacing, and further reduces the potential interference of the adjustable utensil carrier with the loading of tableware and other utensils into the lower basket 36 which do not require placement in the adjustable utensil carrier. The operation of the adjustable utensil carrier 110 with the utensil carrier actuator 70 is identical in every respect to the operation of the adjustable utensil carrier 50.

Figure 13A:
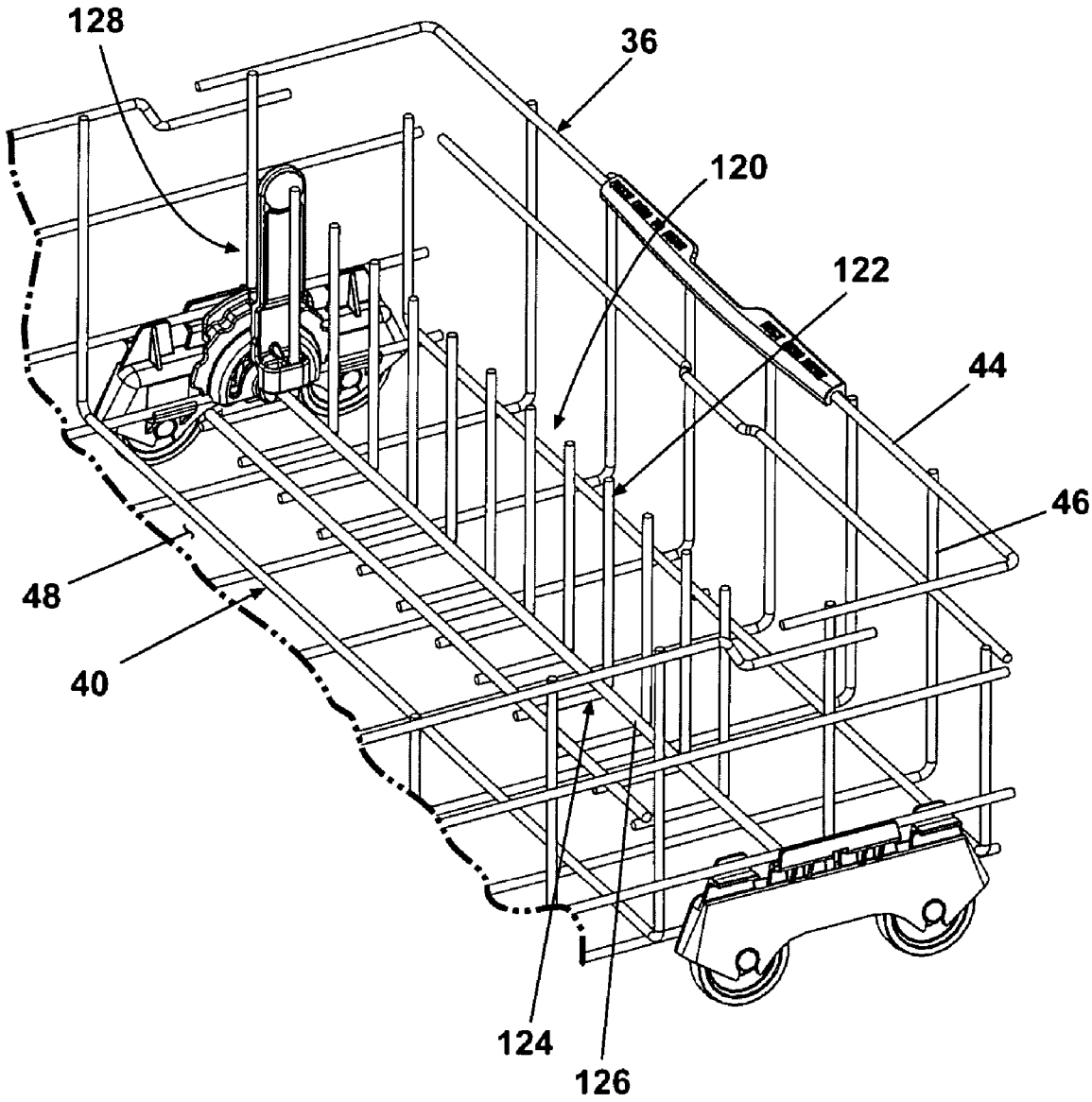
FIG. 13A is an enlarged perspective view of a portion of the lower basket of FIG. 2 illustrating a third embodiment of the adjustable utensil carrier comprising a lever arm assembly for moving the adjustable rack, with the adjustable utensil carrier shown in a first operable position.
Figure 13B:
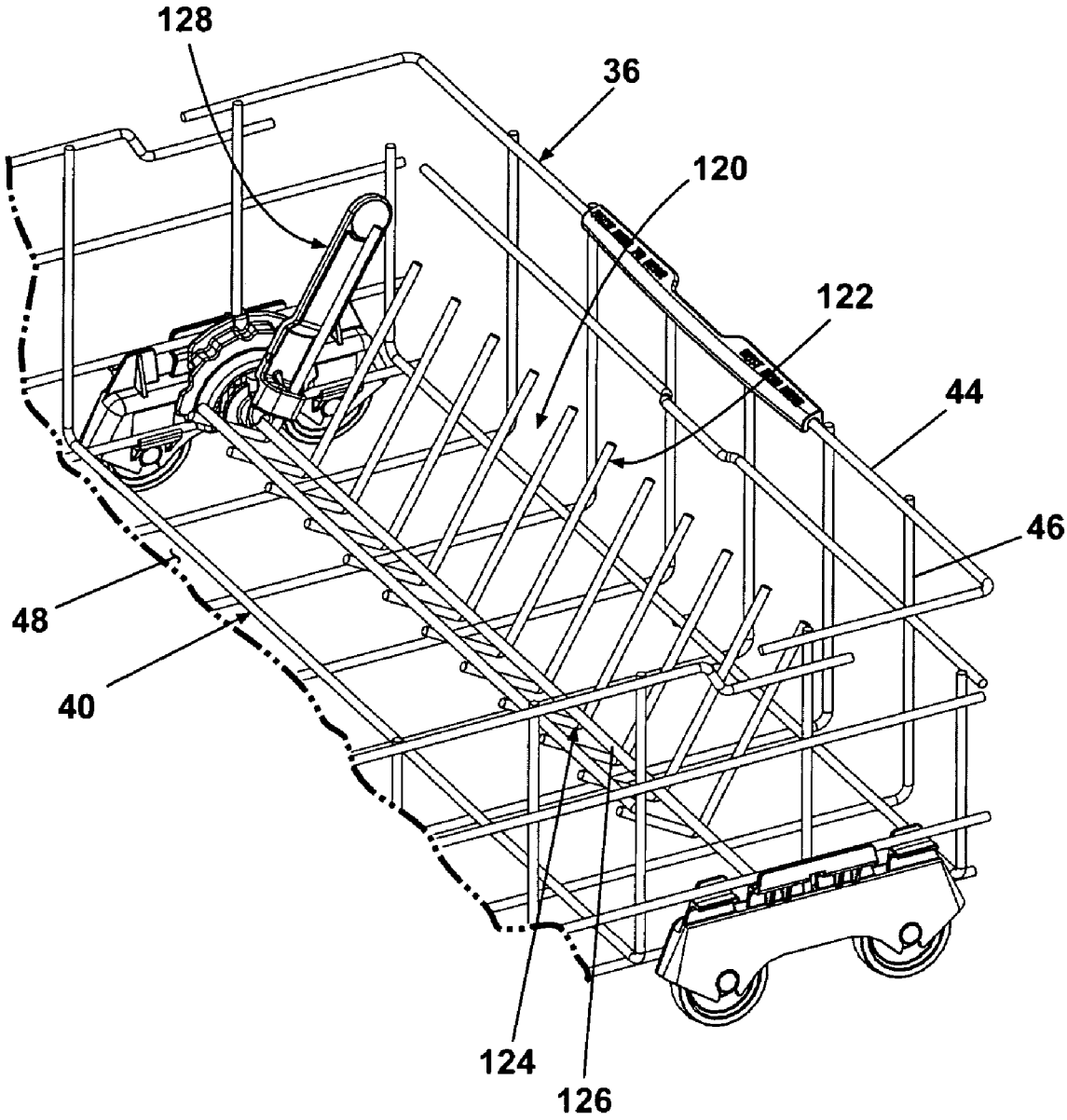
FIG. 13B is an enlarged perspective view similar to the view shown in FIG. 13A illustrating the third embodiment of the adjustable utensil carrier in a second operable position.

FIGS. 13A–16 illustrate a third embodiment of the adjustable utensil carrier 120. As shown in FIGS. 13A–B, the utensil carrier 120 comprises a generally wire-frame construction comprising a planar array of regularly-spaced positioning tines 122 adapted through right-angle bends to form, with suitable cross members 126, a floor latticework 124. The positioning tines 122 extend generally orthogonally upwardly from the floor latticework 124 to form a support wall for supporting a cooking utensil in the optimal cleaning position.

Figure 14:
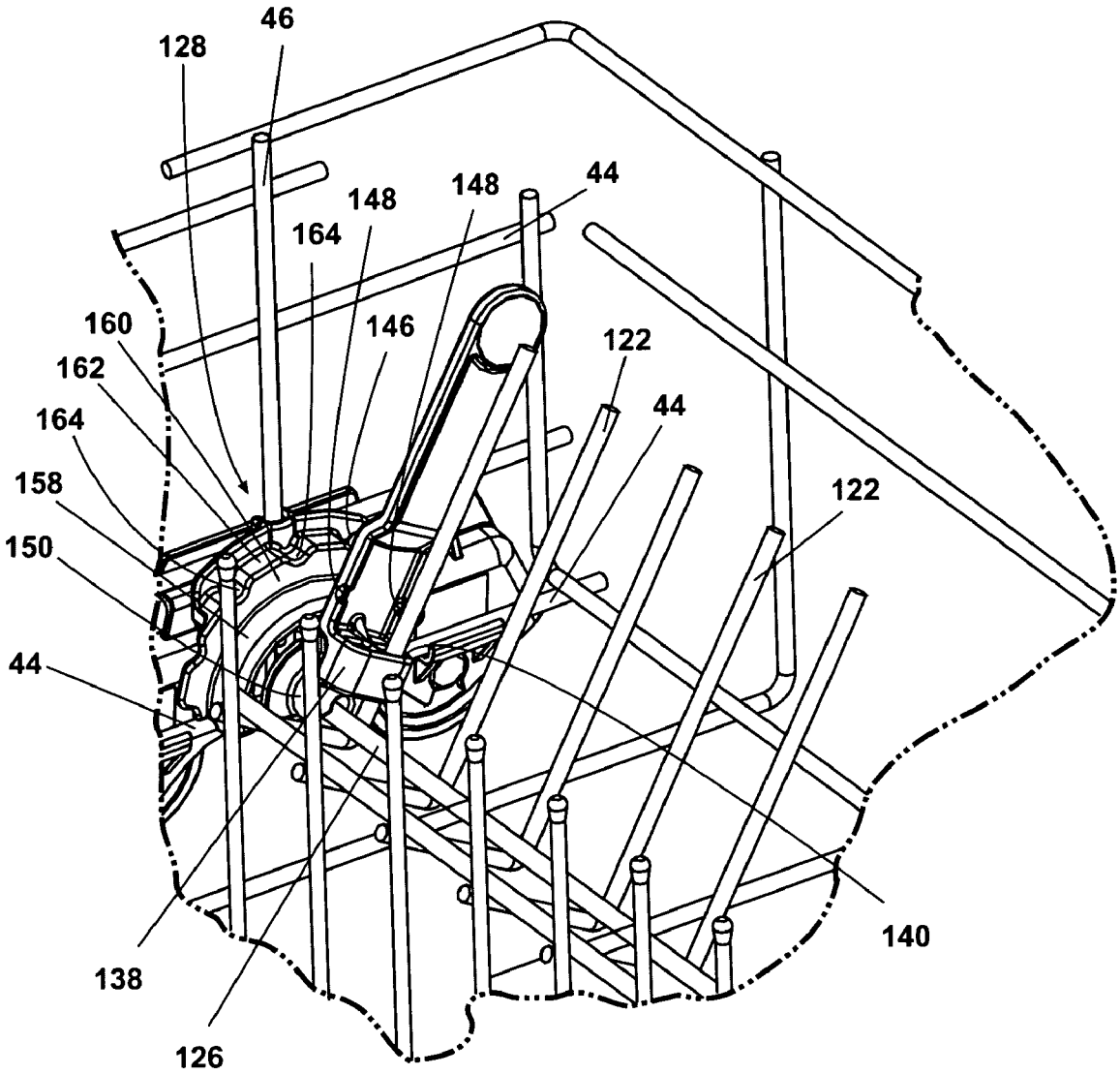
FIG. 14 is an enlarged perspective view of an obverse side of the lever arm assembly shown in FIG. 13A, with the lever arm assembly mounted to the lower basket and the adjustable utensil carrier.
Figure 15:
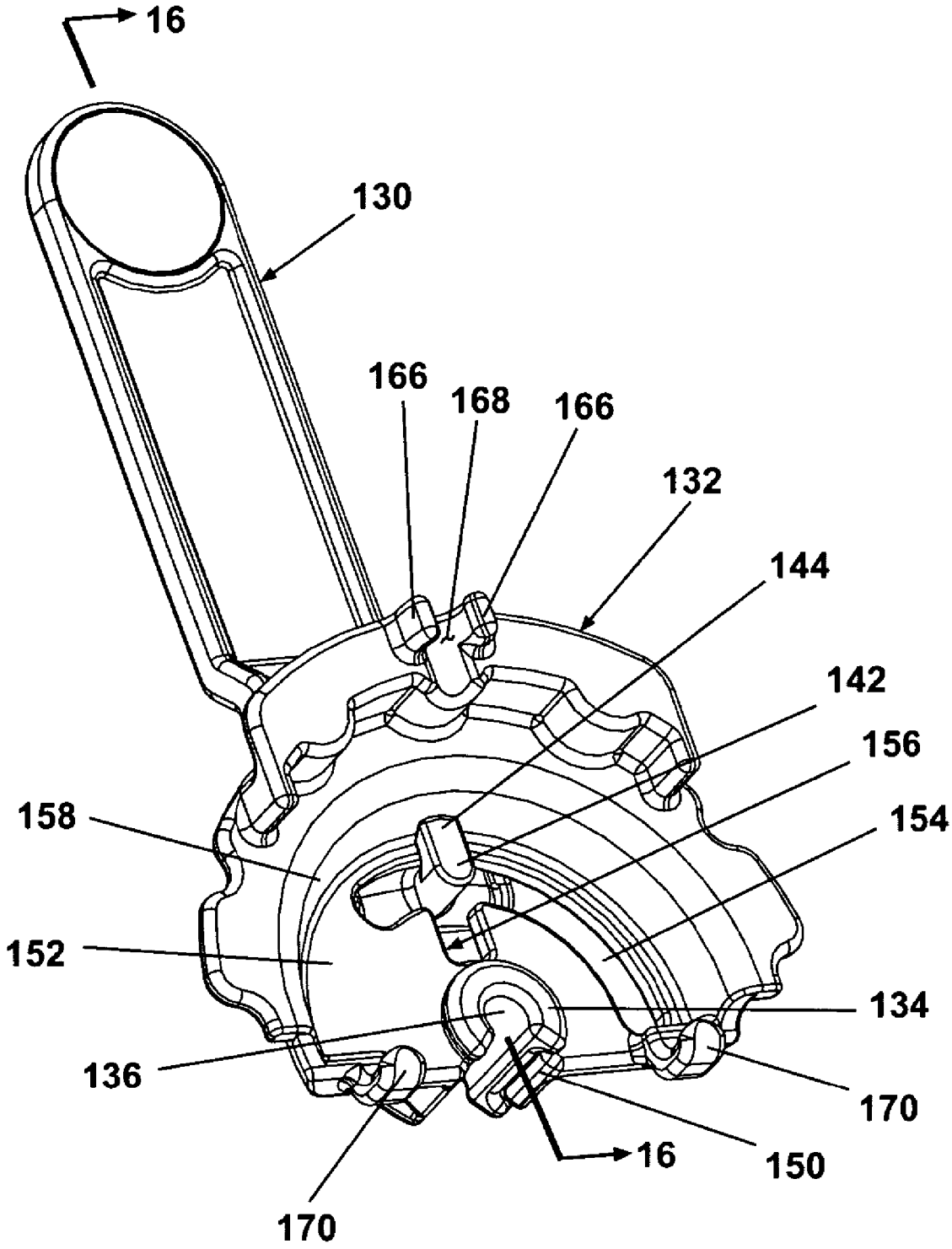
FIG. 15 is an enlarged perspective view of a reverse side of the lever arm assembly shown in FIG. 14.
Figure 16:
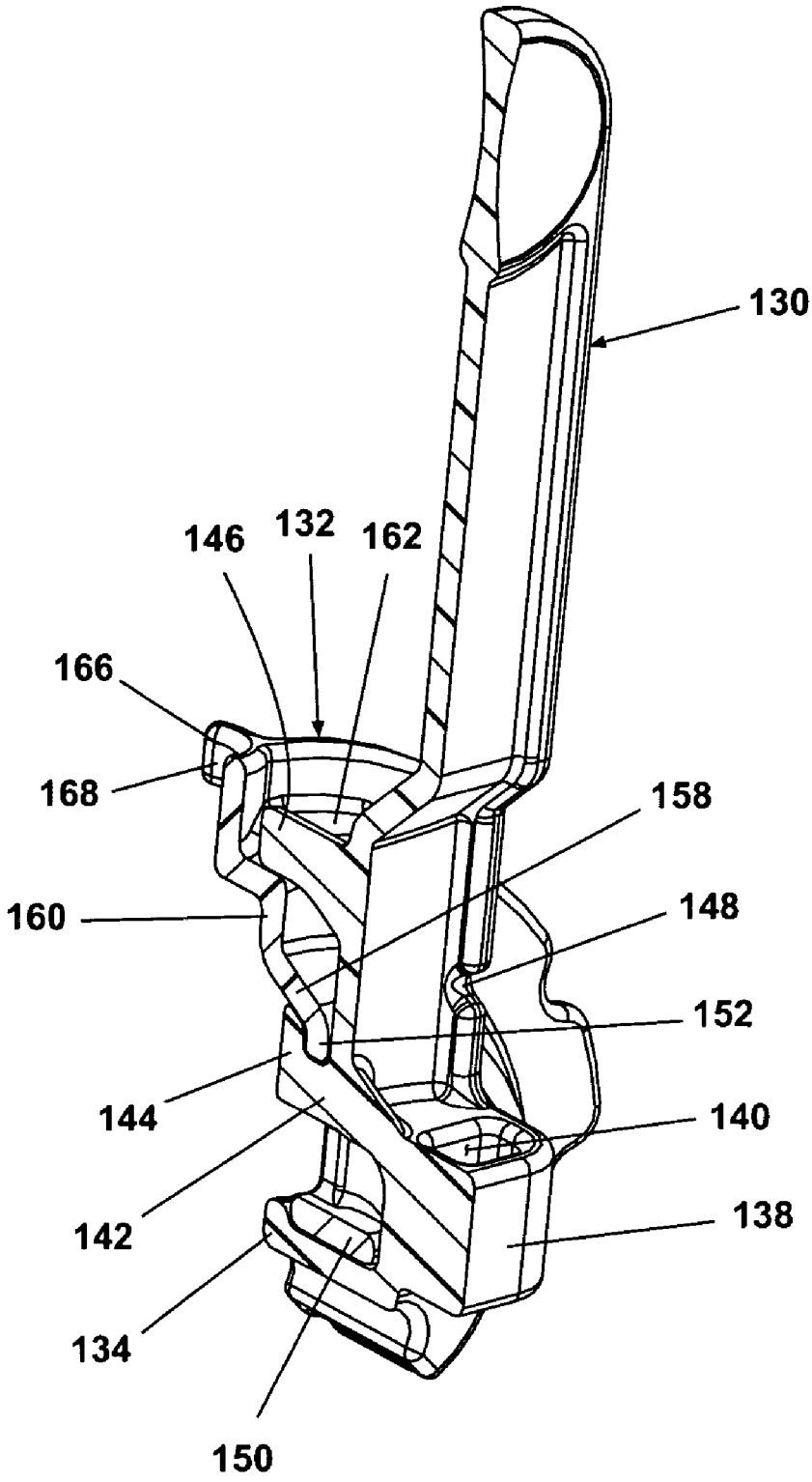
FIG. 16 is a perspective sectional view of the lever arm assembly shown in FIG. 15 taken along line 16–16.

FIGS. 14–16 illustrate a detent latch 128 which is used to adjust the positioning of the utensil carrier 120. The detent latch 128 comprises an adjustment lever 130 and a detent housing 132. The adjustment lever 130 is a generally elongated, irregularly shaped lever-like body terminating at one end in a pivot shaft 134 extending outwardly from an outer surface orthogonal to the plane of the adjustment lever 130. The pivot shaft 134 comprises a C-shaped, semi-annular wall defining a wire channel 136 extending coaxially therethrough.

Adjacent the pivot shaft 134 and along the opposing face of the adjustment lever 130, a wire collar 138 is a lug-like projection extending outwardly from an inner surface orthogonal to the plane of the adjustment lever 130 having at least one wire opening 140 extending therethrough parallel to the longitudinal axis of the adjustment lever 130, and adapted for insertion of a tine 122 therethrough. Adjacent the wire collar 138 is a flex line, shown in FIGS. 14 and 16 as a pair of spaced-apart flex grooves 148, which enables the adjustment lever 130 to be bent along the flex line. It will be readily apparent that the flex line can be also defined by a single groove extending laterally across the adjustment lever 130, or some other suitable structure providing a line of relative weakness laterally across the adjustment lever 130 to enable bending of the adjustment lever 130 therealong.

Spaced away from the flex grooves 148 opposite the wire collar 138 is a cylindrical positioning pin 146 extending outwardly from the outer surface of the adjustment lever 130, orthogonal to the plane of the adjustment lever 130, and parallel to the pivot shaft 134. Intermediate the positioning pin 146 and the pivot shaft 134 is a slide pin 142 extending outwardly from the outer surface of the adjustment lever 130, orthogonal to the plane of the adjustment lever 130, and parallel to the positioning pin 146 and the pivot shaft 134. The slide pin 142 terminates in a slide pin flange 144 extending orthogonally therefrom toward the positioning pin 146 in parallel, spaced-apart juxtaposition to the adjustment lever 130.

The detent housing 132 is an irregularly-shaped, somewhat arcuate body comprising a pivot plate 152 having a semi-annular bearing 150 formed orthogonal thereto and adapted for coaxial slidable insertion of the pivot shaft 134. The pivot plate 152 is provided with an arcuate slot 154 extending radially outwardly from and circumferentially about the bearing 150. The arcuate slot 154 is provided with an elongated insertion slot 156 extending radially inwardly toward the bearing 150.

The pivot plate 152 transitions to an arcuate wall 158 spaced radially away from the arcuate slot 154 and extending at an inclination away from the pivot plate 152. The arcuate wall 158 transitions to an arcuate flange 160 spaced radially away from the arcuate wall 158 generally parallel to the pivot plate 152. The arcuate flange 160 transitions to an arcuate detent wall 162 spaced radially away from the arcuate wall 158 and generally perpendicular to the arcuate flange 160. The detent wall 162 is provided with a plurality of regularly circumferentially spaced pin detents 164 adapted to cradle the positioning pin 146 therein.

Extending generally orthogonally outwardly from a lower edge of the pivot plate 152 is a pair of wire hooks 170. Extending orthogonally outwardly from an upper edge of the detent wall 162 are a pair of spaced-apart wire bosses 166 defining a wire channel 168 veer between and adapted for insertion of a vertical member 46 therein. The detent latch 128 is assembled by joining the adjustment lever 130 to the detent housing 132 by inserting the slide pin 142 into the insertion slot 156. It will be recognized that the pivot shaft 134 will be spaced away from the bearing 150, and it will be necessary to hold the adjustment lever 130 away from the detent housing 132 along the flex grooves 148 since the positioning pin 146 will be in contact with the arcuate flange 160. The adjustment lever 130 is then slidably translated relative to the detent housing 132 by inserting the pivot shaft 134 into the bearing 150 so that the slide pin 142 is positioned in the arcuate slot 154 and the slide pin flange 144 is in communication with the pivot plate 152 adjacent the arcuate wall 158.

The adjustment lever 130 can then be pivoted at relative to the detent housing 132 by pulling the adjustment lever 130 away from the detent housing 132 to enable the positioning pin 146 to be moved from one pin detent 164 to another. Release of the adjustment lever 130 will seat the positioning pin 146 in a selected pin detent 164, thereby retaining the adjustment lever 130 in a selected position. The length and positioning of the arcuate slot 154 is selected so that contact of the slide pin 142 with the ends of the arcuate slot 154 will stop the adjustment lever 130 at preselected limit positions, such as coplanar with the floor latticework 40 and inclined for optimal cleaning positioning of the pan 102. Additionally, while three pin detents 164 are shown in FIG. 14, the number of detents can be selected to accommodate a desired number of tine positions greater than or less than three.

The utensil carrier 120 is attached to the detent latch 128 by insertion of the crossmember 126 into the wire channel 136. It is preferable that the pivot shaft 134 be adapted so that the crossmember 126 is retained in the wire channel 136 through a friction fit or snap-fit mechanism. At the same time, an end tine 122 is inserted through the wire opening 140 parallel with the adjustment lever 130 so that pivoting of the adjustment lever 130 relative to the detent housing 132 will urge the pivoting of the utensil carrier 120 relative to the detent housing 132. The detent latch 128 and the utensil carrier 120 are then attached to the lower basket 36 by hooking the wire hooks 170 around a first crossmember 44 and inserting a vertical member 46 into the wire channel 168. It will be obvious that a suitable crossmember receptacle (not shown) will also be attached to the lower basket 36 for pivotable support of the opposite end of the crossmember 126. It is preferable that the wire hooks 170 be adapted so that the crossmember 44 is retained in the wire hooks 170 through a friction fit or snap-fit mechanism. It is also preferable that the wire channel 168 be adapted so that the vertical member 46 is retained in the wire channel 168 through a friction fit or snap-fit mechanism. The detent housing 132 can also be attached to the lower basket 36 through a suitable bracket mechanism comprising one or more brackets and screws or other suitable snap-fit or friction fit mechanisms.

Figure 17A:
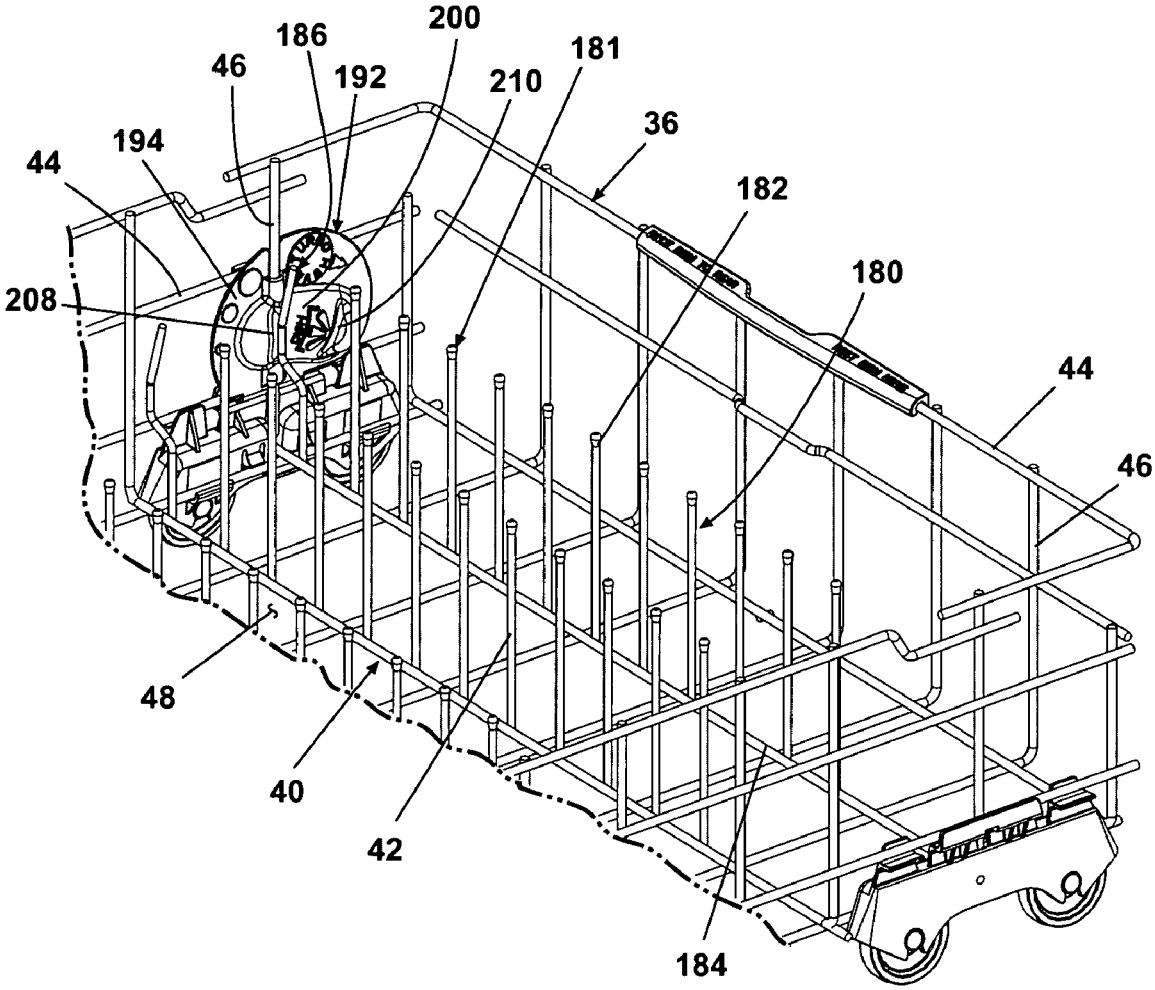
FIG. 17A is an enlarged perspective view of a portion of the lower basket of FIG. 2 illustrating a fourth embodiment of the adjustable utensil carrier comprising a time lock assembly for positioning the adjustable utensil carrier, with the adjustable utensil carrier shown in a first operable position.
Figure 17B:
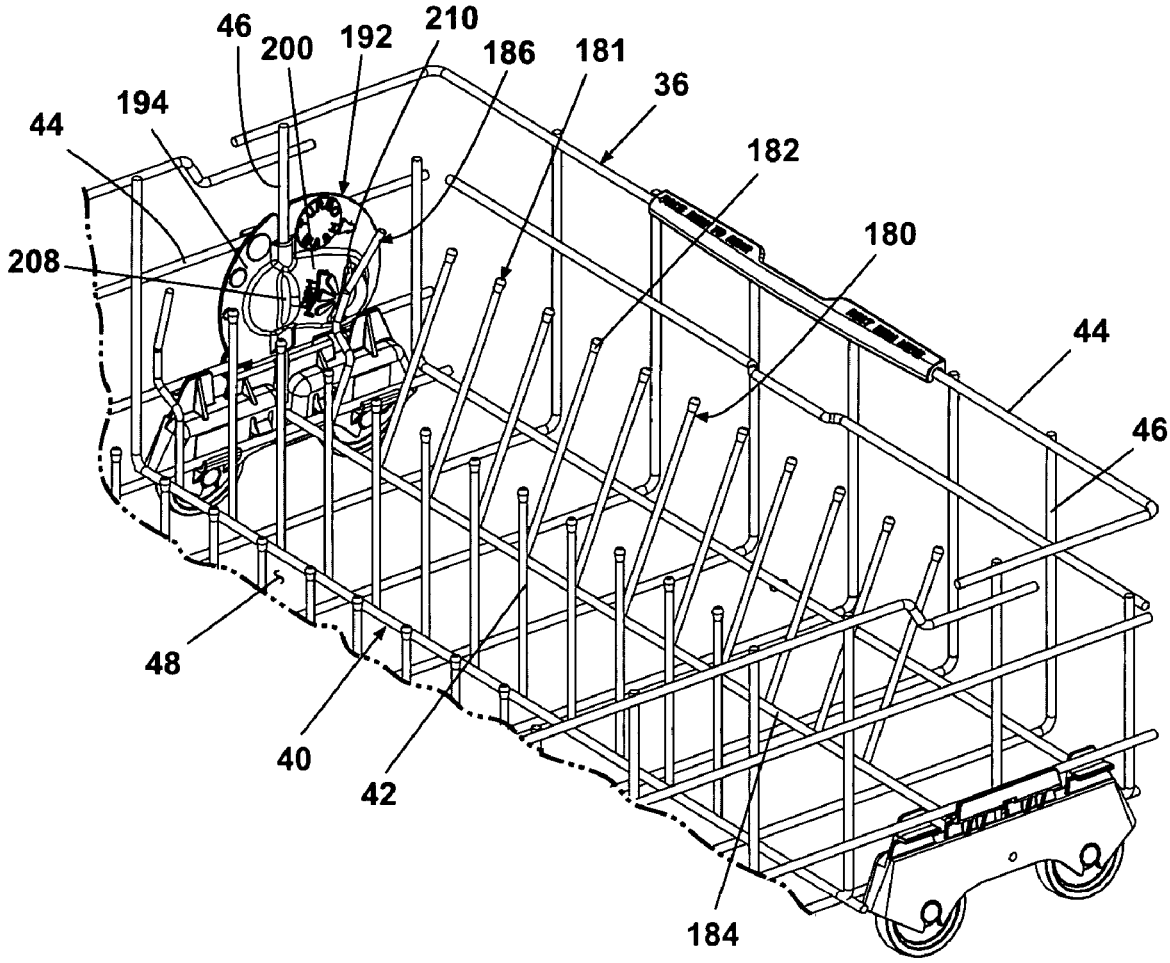
FIG. 17B is an enlarged perspective view similar to the view shown in FIG. 17A illustrating the fourth embodiment of the adjustable utensil carrier in a second operable position.
Figure 18:
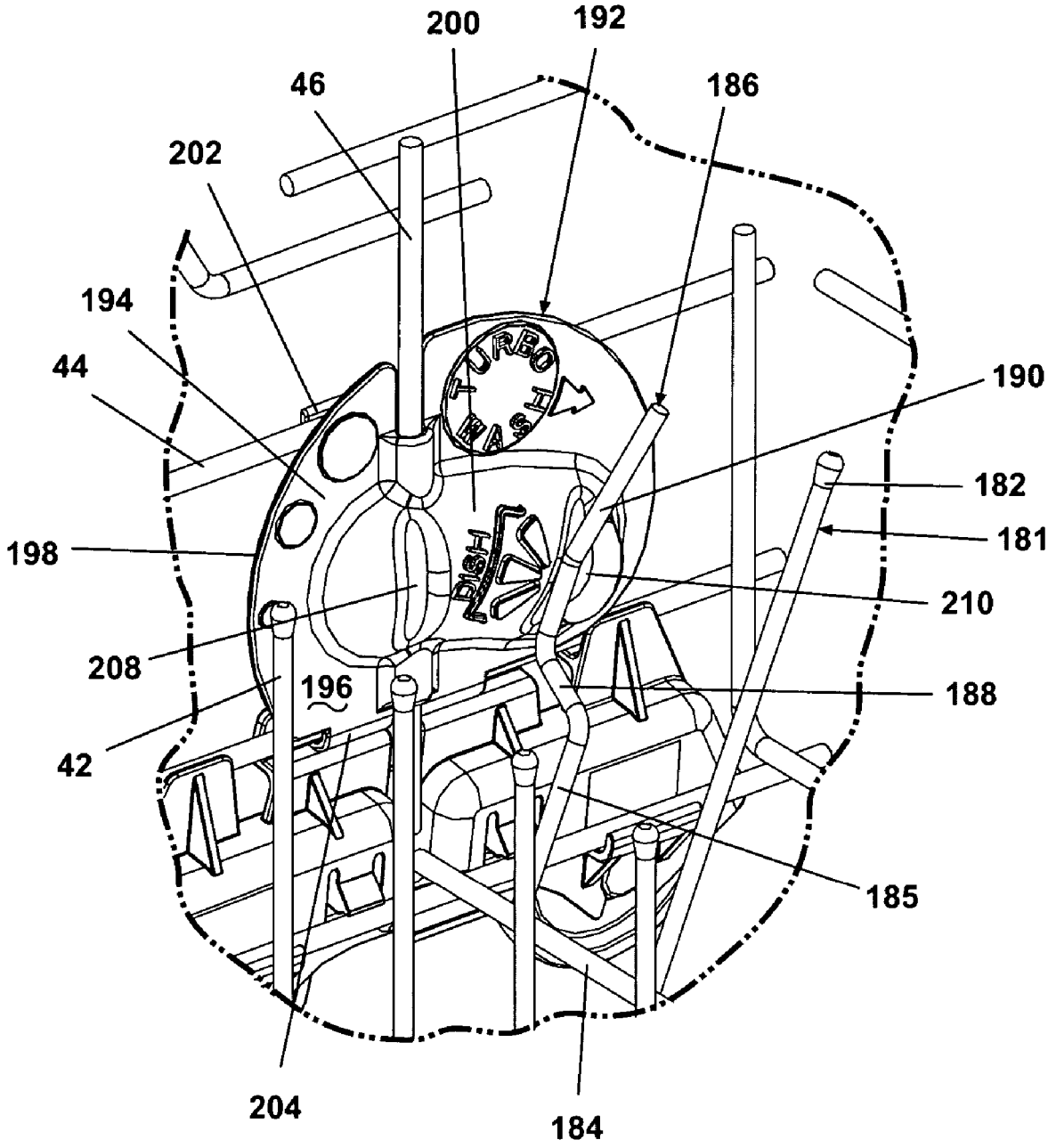
FIG. 18 is an enlarged perspective view of an obverse side of the tine lock assembly shown in FIG. 17A, with the tine lock assembly mounted to the lower basket and the adjustable utensil carrier.

FIGS. 17A–18 show a fourth embodiment of an adjustable utensil carrier 180 comprising an adjustable rack 181 and a detent latch 192. The adjustable rack 181 comprises a planar array of parallel positioning tines 182 rigidly attached to a pivot wire 184 and adapted to extend orthogonally therefrom into the utensil holding space 48 to form a support wall for supporting a cooking utensil in the optimal cleaning position. The array of positioning tines 182 terminates with a locking tine 186 having an attachment portion 185 transitioning to an offset portion 188 which terminates in an engagement portion 190 offset from and parallel to the attachment portion 185 and the remaining positioning tines 182 in the array.

The detent latch 192 comprises a somewhat oval-shaped mounting plate 194 having an obverse face 196 and a reverse face 198. The reverse face 198 is adapted for cooperative juxtaposition with the perimeter latticework 38. A wire detent 206 extends through one end of the mounting plate 194 offset from the reverse face 198 for slidable receipt of a vertical member 46. At least one upper wire hook 202 extends generally orthogonally from an upper portion of the reverse face 198. At least one lower wire hook 204 extends generally orthogonally from a lower edge of the reverse face 198. The wire hooks 202, 204 are adapted to engage crossmembers 44, preferably through a friction fit or snap-fit mechanism.

The obverse side 196 is provided with a semi-ovoid shaped adjustment boss 200 extending outwardly therefrom and having a standard position channel 208 and a cleaning position channel 210 extending therethrough. The standard position channel 208 is adapted for receipt of the engagement portion 190 of the locking tine 186 for positioning of the adjustable rack 181 with the positioning tines 182 in a generally vertical orientation. The cleaning position channel 210 is adapted for receipt of the engagement portion 190 for positioning of the adjustable rack 181 with the positioning tines 182 in an inclined orientation providing optimal cleaning of a pan 102 supported thereby. A suitable pivot wire receptacle 212, shown in FIG. 18 as formed in a lower basket wheel assembly, is provided for pivotable support of a first end of the pivot wire 184 and the adjustable rack 181. It will be recognized that a similar pivot wire receptacle (not shown) will be provided at the opposite side of the lower basket 36 for pivotable support of the second end of the pivot wire 184. It will also be recognized that the pivot wire receptacle 212 can take other configurations suitable for supporting and enabling the pivoting of the adjustable rack 181 relative to the lower basket 36.

The detent latch 192 is attached to the lower basket 36 by aligning the detent latch 192 with the perimeter latticework 38 so that a vertical member 46 can be inserted into the wire detent 206. The upper wire hooks 202 and the lower wire hooks 204 engage cross members 44 through a friction fit or snap-fit mechanism to secure the detent latch 192 to the lower basket 36. The adjustable rack 181 is then installed with the locking tine 186 positioned in the standard position channel 208 or the cleaning position channel 210. The adjustable rack 181 can be selectively positioned in either the standard position or the cleaning position as follows.

The adjustable rack 181 can be positioned relative to the lower basket 36 by pulling inwardly on the locking tine 186 sufficient to remove the engagement portion 190 from the position channel 208, 210 in which it is held. The adjustable rack 181 can then be pivoted to align the engagement portion 190 with the other of the position channels 208, 210, followed by release of the locking tine 186 so that the engagement portion 190 is seated in the selected position channel. The adjustable rack 181 can also be pivoted so that the positioning tines 122 lay essentially on or coplanar with the floor latticework 40. Alternatively, the detent latch 192 can be provided with a plurality of position channels to enable the adjustable rack 181 to be placed in several selected positions.

Figure 19:
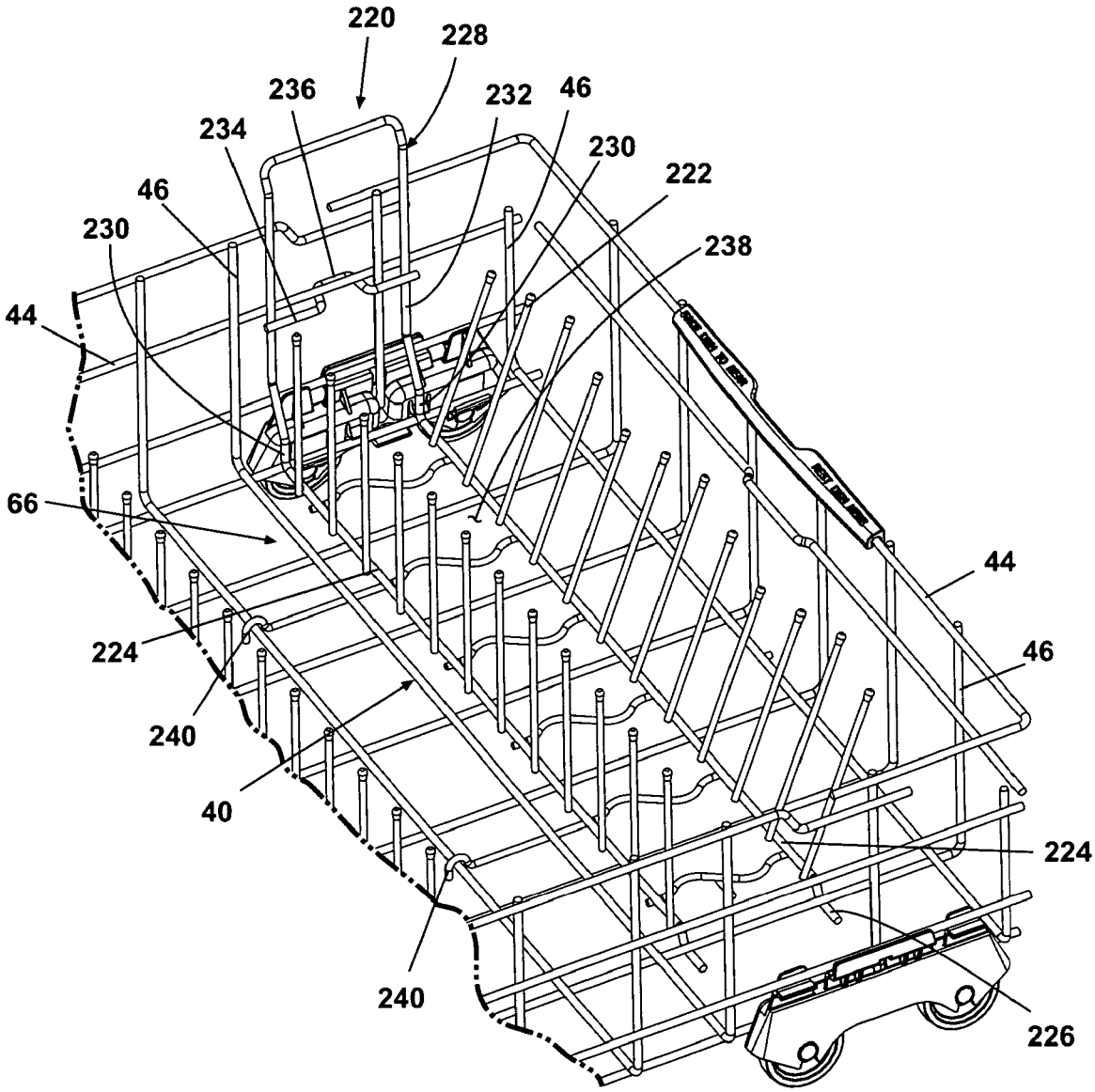
FIG. 19 is an enlarged perspective view of a portion of the lower basket of FIG. 2 illustrating a fifth embodiment of the adjustable utensil carrier comprising a removable rack having positioning tines in an operable position for optimally positioning the cooking utensil.

A fifth embodiment of the adjustable utensil carrier 220 is shown in FIG. 19. The adjustable utensil carrier 220 is a wire basket-like structure having a wire-frame construction and configuration. As shown in FIG. 19, the utensil carrier 220 comprises at least one planar array of positioning tines 222 rigidly attached to at least two parallel, spaced-apart floor wires 224 and adapted to extend therefrom into the utensil holding space 48 to form a support wall for supporting a cooking utensil at an optimal angle for cleaning. The positioning tines 222 define a utensil holding space 238. Each floor wire 224 terminates at a first end in an offset wire hook 226 adapted to fit beneath a wire member comprising part of the floor latticework 40 when the utensil carrier 220 is supported thereon. The floor wires 224 extend through elbows 230 to form vertical wires 232 adapted for cooperative register with the perimeter latticework 38. Extending laterally between the vertical wires 232 is a hook wire 234 having a wire hook 236 at its mid length adapted to fit beneath a crossmember 44. A plurality of floor hooks 240 can also be provided extending laterally across the floor wires 224 to engage wire members 44 in the floor latticework 40 for further supporting the utensil carrier 220 in the lower basket 36.

The utensil carrier 220 is attached to the lower basket 36 by hooking the wire hooks 226 beneath a wire in the floor latticework 40, hooking the floor hooks 240 over a wire in the floor latticework 40, and supporting the floor wires 224 on the floor latticework 40. The wire hook 236 is also inserted beneath a cross member 44 comprising a portion of the perimeter latticework 38 to securely hold the utensil carrier 220 to the lower basket 36. This can be accomplished by pulling inwardly on the vertical wires 232, pushing outwardly on the cross member 44, or a combination of both. When is unnecessary to utilize the utensil carrier 220 for cleaning a large cooking pan, the utensil carrier 220 can be easily removed, thereby freeing up the lower basket 36 for loading of tableware and the like.

The fifth embodiment is the less preferred embodiment since it requires the elimination of tines in the portion of the dishrack that receives the removable basket of the fifth embodiment. The first through the fourth embodiments accomplish the orienting of a utensil without eliminating the tines that can otherwise be used to support other utensils. The fifth embodiment reduces the overall functionality of the dishrack in order to provide the functionality for cleaning utensils with a peripheral wall or large surfaces.

While the invention has been specifically described in connection with certain embodiments thereof, it is to be understood that this is by way of illustration and not of limitation. Reasonable variation and modification are possible within the scope of the forgoing description and drawings without departing from the spirit of the invention, which is described in the appended claims.

What is claimed is:

1. A dishwasher for washing dishes, comprising:

a tub comprising a peripheral wall defining a wash chamber;

a basket positionable within the wash chamber, and comprising a bottom wall, and a peripheral wall extending upwardly from the bottom wall to define a utensil holding space;

a water spray assembly located within the wash chamber such that the water spray assembly sprays liquid into the utensil holding space through the bottom wall of the basket;

at least one side sprayer located in the wash chamber such that the at least one side sprayer sprays liquid laterally into the utensil holding space; and an adjustable utensil carrier having a bottom wall is located within the utensil holding space and adjustable for pivotal movement relative to the basket between a first position, where a food contact surface of a utensil carried by the utensil carrier is primarily directed toward the spray from one of the water spray assembly and the at least one side sprayer, and a second position, where the food contact surface is directed toward the spray from both the water spray assembly and the at least one side sprayer.

2. The dishwasher according to claim 1, wherein the adjustable utensil carrier is moveable to a cleaning position where the adjustable utensil carrier is at an acute angle relative to the bottom of the basket to form an angle of inclination.

3. The dishwasher according to claim 2, wherein the inclination angle relative to the peripheral wall is approximately 35 degrees.

4. The dishwasher according to claim 2, wherein the adjustable utensil carrier comprises a support wall that is moveable between a stored position generally perpendicular to the bottom of the basket and the cleaning position.

5. The dishwasher according to claim 4, wherein the support wall is pivotally mounted to the basket.

6. The dishwasher according to claim 5, wherein the support wall is hingedly mounted to the peripheral wall.

7. The dishwasher according to claim 4, wherein the support wall comprises a wire frame wall.

8. The dishwasher according to claim 7, wherein the wire frame wall spans the utensil holding space.

9. The dishwasher according to claim 8, wherein the peripheral wall comprises opposing side walls and the wire frame wall extends between the opposing side walls.

10. The dishwasher according to claim 9, and further comprising at least one detent latch mounted to one of the side walls and the detent latch having a detent in which a portion of the side wall is received to hold the wire frame wall in the cleaning position.

11. The dishwasher according to claim 10, wherein the detent latch has multiple detents to define multiple use positions, with the wire frame wall forming a different acute angle relative to the bottom wall for each of the use positions.

12. The dishwasher according to claim 4, and further comprising an actuator coupling the support wall to the peripheral wall for moving the support wall into the cleaning position.

13. The dishwasher according to claim 4, wherein the support wall defines a utensil support space adapted to support a cooking utensil within the utensil holding space.

14. The dishwasher according to claim 1, wherein the basket is movably mounted to the tub for movement between a stored position, where the basket is completely received within the wash chamber, and a load position, where at least a portion of the basket extends beyond the wash chamber.

15. The dishwasher according to claim 1, wherein the utensil carrier is rotated about a horizontal axis to move the utensil carrier between the first position and the second position, wherein in the first position the utensil carrier forms a first inclination angle and in the second position the utensil carrier forms a second inclination angle that is different than the first inclination angle.

16. A dishwasher for washing dishes, comprising:

a tub comprising a peripheral wall defining a wash chamber;

a basket positionable within the wash chamber, and comprising a bottom wall, and a peripheral wall extending upwardly from the bottom wall to define a utensil holding space;

a water spray assembly located within the wash chamber such that the water spray assembly sprays liquid into the utensil holding space through the bottom wall of the basket;

at least one side sprayer located in the wash chamber such that the at least one side sprayer sprays liquid laterally into the utensil holding space;

an adjustable utensil carrier located within the utensil holding space and adjustable for relative movement between a first position, where a food contact surface of a utensil carried by the utensil carrier is primarily directed toward the spray from one of the water spray assembly and the at least one side sprayer, and a second position, where the food contact surface is directed toward the spray from both the water spray assembly and the at least one side sprayer;

the adjustable utensil carrier includes a support wall that is moveable between a stored position generally perpendicular to the bottom of the basket and the cleaning position, wherein the adjustable utensil carrier is moveable to a cleaning position where the adjustable utensil carrier is at an acute angle relative to the bottom of the basket to form the angle of inclination; and an actuator coupling the support wall to the peripheral wall for moving the support wall into the cleaning position, wherein the actuator comprises an over-center latch for holding the support wall in a use position.

17. The dishwasher according to claim 16, wherein the actuator comprises a pivot mechanism comprising a lever, a pivot, and at least one cam, the pivot being pivotably attached to the adjustable utensil carrier, the lever adapted to extend from the pivot into the adjustable utensil carrier, and the at least one cam adapted to extend from the pivot to engage the basket, the pivot mechanism being pivotable between a first pivot position and a second pivot position corresponding to the cleaning position.

18. The dishwasher according to claim 17, wherein the support wall defines an adjustable utensil carrier having a utensil holding space adapted to support a cooking utensil within the utensil holding space.

19. The dishwasher according to claim 18, wherein, in the first pivot position, the lever extends into the utensil support space and the at least one cam is below the pivot, and in the second pivot position, the lever is retracted away from the utensil support space and the at least one cam is above the pivot to form the over-center latch.

20. The dishwasher according to claim 19, wherein, in the first pivot position, the lever extends into the utensil support space and the at least one cam is below the lever, and in the second pivot position, the lever is retracted away from the utensil support space and the at least one cam is above the lever.

21. The dishwasher according to claim 20 wherein placement of the cooking utensil in the adjustable utensil carrier pivots the lever and the at least one cam from the first pivot position to the second pivot position, and the adjustable utensil carrier from a first rack position to a second rack position.

22. A basket for a dishwasher comprising at least one side sprayer and a rotating water spray assembly for washing utensils, the basket comprising:

a bottom wall;

a peripheral wall extending upwardly from the bottom wall to define a utensil holding space for holding utensils placed in the basket for washing;

an adjustable utensil carrier located within the utensil holding space and adjustable for relative movement between a first position, where a food contact surface of a utensil carried by the utensil carrier is primarily directed toward the spray from one of the water spray assembly and the at least one side sprayer, and a second position, where the food contact surface is directed toward the spray from both the water spray assembly and the at least one side sprayer;

the adjustable utensil carrier includes a support wall that is moveable between a stored position generally perpendicular to the bottom of the basket and the cleaning position, wherein the adjustable utensil carrier is moveable to a cleaning position where the adjustable utensil carrier is at an acute angle relative to the bottom of the basket to form the angle of inclination; and an actuator coupling the support wall to the peripheral wall for moving the support wall into the cleaning position, wherein the actuator comprises an over-center latch for holding the support wall in a use position.

23. The basket according to claim 22, wherein the actuator comprises a pivot mechanism comprising a lever, a pivot, and at least one cam, the pivot being pivotably attached to the adjustable utensil carrier, the lever adapted to extend from the pivot into the adjustable utensil carrier, and the at least one cam adapted to extend from the pivot to engage the basket, the pivot mechanism being pivotable between a first pivot position and a second pivot position corresponding to the cleaning position.

24. The basket according to claim 23, wherein the support wall defines an adjustable utensil carrier having a utensil holding space adapted to support a cooking utensil within the utensil holding space.

25. The basket according to claim 24, wherein, in the first pivot position, the lever extends into the utensil support space and the at least one cam is below the pivot, and in the second pivot position, the lever is retracted away from the utensil support space and the at least one cam is above the pivot to form the over-center latch.

26. The basket according to claim 25, wherein, in the first pivot position, the lever extends into the utensil support space and the at least one cam is below the lever, and in the second pivot position, the lever is retracted away from the utensil support space and the at least one cam is above the lever.

27. The basket according to claim 26 wherein placement of the cooking utensil in the adjustable utensil carrier pivots the lever and the at least one cam from the first pivot position to the second pivot position, and the adjustable utensil carrier from a first rack position to a second rack position.

28. A basket for a dishwasher comprising at least one side sprayer and a rotating water spray assembly for washing utensils, the basket comprising:

a bottom wall;

a peripheral wall extending upwardly from the bottom wall to define a utensil holding space for holding utensils placed in the basket for washing; and an adjustable utensil carrier having a bottom wall is located within the utensil holding space and adjustable for pivotal movement relative to the basket between a first position, where a food contact surface of a utensil carried by the utensil carrier is primarily directed toward the spray from one of the water spray assembly and the at least one side sprayer, and a second position, where the food contact surface is directed toward the spray from both the water spray assembly and the at least one side sprayer.

29. The basket according to claim 28, wherein the adjustable utensil carrier is moveable to a cleaning position where the adjustable utensil carrier is at an acute angle relative to the bottom of the basket to form an angle of inclination.

30. The basket according to claim 29, wherein the inclination angle relative to the peripheral wall is 35 degrees.

31. The basket according to claim 29, wherein the adjustable utensil carrier comprises a support wall that is moveable between a stored position generally perpendicular to the bottom of the basket and the cleaning position.

32. The basket according to claim 31, wherein the support wall is hingedly mounted to the peripheral wall.

33. The basket according to claim 31, and further comprising an actuator coupling the support wall to the peripheral wall for moving the support wall into the cleaning position.

34. The basket according to claim 31, wherein the support wall defines a utensil support space adapted to support a cooking utensil within the utensil holding space.

35. The basket according to claim 31, wherein the support wall comprises a wire frame wall.

36. The basket according to claim 35, wherein the wire frame wall spans the utensil holding space.

37. The basket according to claim 36, wherein the peripheral wall comprises opposing side walls and the wire frame wall extends between the opposing side walls.

38. The basket according to claim 37, and further comprising at least one detent latch mounted to one of the side walls and the detent latch having a detent in which a portion of the side wall is received to hold the wire frame wall in the cleaning position.

39. The basket according to claim 38, wherein the detent latch has multiple detents to define multiple use positions, with the wire frame wall forming a different acute angle relative to the bottom wall for each of the use positions.

* * * * *